US005379707A

United States Patent [19]

Asano

[11] Patent Number: 5,379,707

[45] Date of Patent: Jan. 10, 1995

[54] STITCH DATA PREPARING DEVICE FOR EMBROIDERY SEWING MACHINE

[75] Inventor: Fumiaki Asano, Nagoya, Japan

[73] Assignee: Brother Kogyo Kabushiki Kaisha, Nagoya, Japan

[21] Appl. No.: 107,361

[22] Filed: Aug. 17, 1993

[30] Foreign Application Priority Data

Aug. 17, 1992 [JP] Japan ..... 4-241163

[51] Int. Cl.[6] ..... D05B 21/00

[52] U.S. Cl. ..... 112/121.12; 112/103; 112/266.1

[58] Field of Search ..... 112/121.12, 121.11, 112/103, 266.1, 262.3, 457; 364/470

[56] References Cited

U.S. PATENT DOCUMENTS 5,181,176 1/1993 Hayakawa ..... 112/266.1 X
5,261,341 11/1993 Asano ..... 112/121.12 X
5,283,748 2/1994 Muramatsu ..... 112/266.1 X

*Primary Examiner*—Peter Nerbun
*Attorney, Agent, or Firm*—Oliff & Berridge

[57] ABSTRACT

A stitch data preparing device for an embroidery sewing machine, is capable of automatically determining an optimum embroidery pattern for making embroidery stitches in an embroidery area, according to data of outline defining points, types of line elements of an outline defining the embroidery area input, and at least one main line or subline designated. The stitch data preparing device also automatically prepares stitch data by a stitch data creation control routine corresponding to this optimum embroidery pattern. Accordingly, the number of divisions of the embroidery area is greatly reduced. The shape of the embroidery area is freely set. Further, the embroidery stitches reflecting the shape of the embroidery area are simply formed.

22 Claims, 28 Drawing Sheets

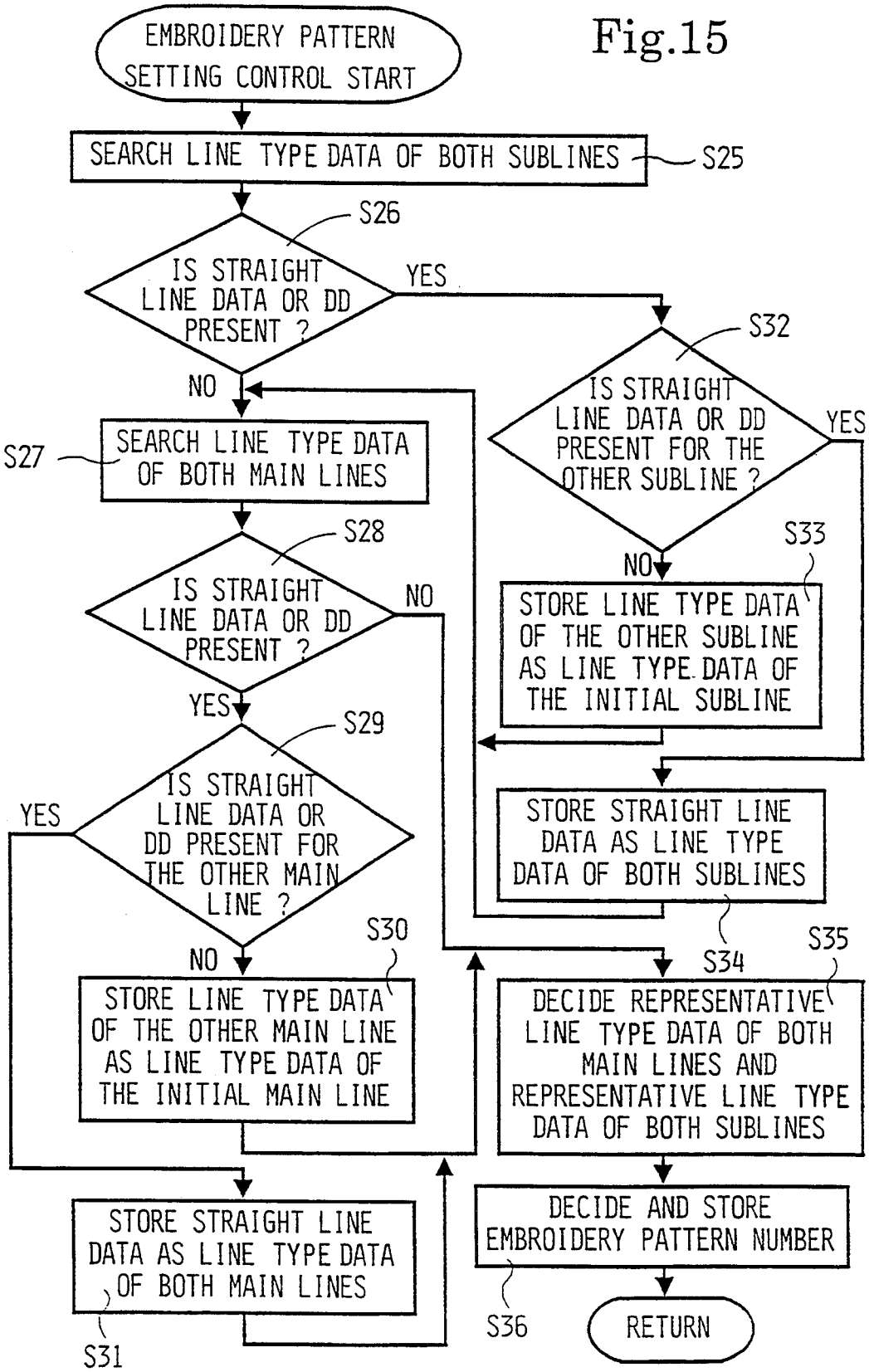
Fig.15
EMBROIDERY PATTERN SETTING CONTROL START
SEARCH LINE TYPE DATA OF BOTH SUBLINES
S25
S26
IS STRAIGHT LINE DATA OR DD PRESENT ?
YES
NO
S27
SEARCH LINE TYPE DATA OF BOTH MAIN LINES
S28
IS STRAIGHT LINE DATA OR DD PRESENT ?
NO
YES
S29
IS STRAIGHT LINE DATA OR DD PRESENT FOR THE OTHER MAIN LINE ?
YES
NO
S30
STORE LINE TYPE DATA OF THE OTHER MAIN LINE AS LINE TYPE DATA OF THE INITIAL MAIN LINE
STORE STRAIGHT LINE DATA AS LINE TYPE DATA OF BOTH MAIN LINES
S31
S32
IS STRAIGHT LINE DATA OR DD PRESENT FOR THE OTHER SUBLINE ?
YES
NO
S33
STORE LINE TYPE DATA OF THE OTHER SUBLINE AS LINE TYPE DATA OF THE INITIAL SUBLINE
STORE STRAIGHT LINE DATA AS LINE TYPE DATA OF BOTH SUBLINES
S34
S35
DECIDE REPRESENTATIVE LINE TYPE DATA OF BOTH MAIN LINES AND REPRESENTATIVE LINE TYPE DATA OF BOTH SUBLINES
DECIDE AND STORE EMBROIDERY PATTERN NUMBER
S36
RETURN

Fig.17B

| ITEM | INSTRUCTIONS |
|---|---|
| S60 | COMPUTE LENGTHS OF FIRST AND SECOND MAIN LINES |
| S61 | COMPUTE LENGTH OF AUXILIARY MAIN LINE |
| S62 | LENGTH OF AUXILIARY MAIN LINE |
| S63 | DIVIDE FIRST MAIN LINE BY M AND STORE DIVISION POINTS u |
| S64 | DIVIDE SECOND MAIN LINE BY M AND STORE DIVISION POINTS w |
| S65 | DIVIDE AUXILIARY MAIN LINE BY 2M AND STORE ODD ONES v OF DIVISION POINTS |
| S66 | STORE POSITION DATA OF END POINT a1 |
| S67 | N ← 1 |
| S68 | STORE POSITION DATA OF DIVISION POINT vN |
| S69 | IS v(N+1) PRESENT ? |
| S70 | STORE POSITION DATA OF END POINT a4 |
| S71 | STORE POSITION DATA OF DIVISION POINT wN |
| S72 | N ← (N+1) |
| S73 | STORE POSITION DATA OF DIVISION POINT vN |
| S74 | STORE POSITION DATA OF DIVISION POINT uN |
| S75 | N ← (N+1) |

Fig.18B

| ITEM | INSTRUCTIONS |
|---|---|
| S80 | COMPUTE LENGTHS OF FIRST AND SECOND AUXILIARY MAIN LINES |
| S81 | COMPUTE AVERAGE X OF LENGTHS OF FIRST AND SECOND AUXILIARY MAIN LINES |
| S82 | $M \leftarrow (X \div t)$ |
| S83 | DIVIDE FIRST MAIN LINE BY M AND STORE DIVISION POINTS u |
| S84 | DIVIDE SECOND MAIN LINE BY M AND STORE DIVISION POINTS w |
| S85 | DIVIDE FIRST AUXILIARY MAIN LINE BY 3M AND STORE DIVISION POINTS j OBTAINED BY REMOVING 3n POINTS AND EVEN POINTS FROM DIVISION POINTS |
| S86 | DIVIDE SECOND AUXILIARY MAIN LINE BY 3M AND STORE DIVISION POINTS k OBTAINED BY REMOVING 3n POINTS AND ODD POINTS FROM DIVISION POINTS |
| S87 | STORE POSITION DATA OF END POINT a1 |
| S88 | $N \leftarrow 1$ |
| S89 | STORE POSITION DATA OF DIVISION POINT jN |
| S90 | STORE POSITION DATA OF DIVISION POINT kN |
| S91 | IS wN PRESENT ? |
| S92 | STORE POSITION DATA OF END POINT a4 |
| S93 | STORE POSITION DATA OF DIVISION POINT wN |
| S94 | $N \leftarrow (N+1)$ |
| S95 | STORE POSITION DATA OF DIVISION POINT kN |
| S96 | STORE POSITION DATA OF DIVISION POINT jN |
| S97 | STORE POSITION DATA OF DIVISION POINT uN |
| S98 | $N \leftarrow (N+1)$ |

Fig.19B

| ITEM | INSTRUCTIONS |
|---|---|
| S100 | COMPUTE MIDPOINT g OF FIRST MAIN LINE AND MIDPOINT h OF SECOND MAIN LINE |
| S101 | COMPUTE POINT r ON PERPENDICULAR BISECTOR OF LINE SEGMENT PQ |
| S102 | COMPUTE LENGTH OF AUXILIARY MAIN LINE |
| S103 | LENGTH OF AUXILIARY MAIN LINE |
| S104 | DIVIDE FIRST MAIN LINE BY M AND STORE DIVISION POINTS u |
| S105 | DIVIDE SECOND MAIN LINE BY M AND STORE DIVISION POINTS w |
| S106 | DIVIDE AUXILIARY MAIN LINE BY 2M AND STORE ODD ONES v OF DIVISION POINTS |
| S107 | STORE POSITION DATA OF END POINT a1 |
| S108 | N ← 1 |
| S109 | STORE POSITION DATA OF DIVISION POINT vN |
| S110 | IS wN PRESENT ? |
| S111 | STORE POSITION DATA OF END POINT a4 |
| S112 | STORE POSITION DATA OF DIVISION POINT wN |
| S113 | N ← (N+1) |
| S114 | STORE POSITION DATA OF DIVISION POINT vN |
| S115 | STORE POSITION DATA OF DIVISION POINT uN |
| S116 | N ← (N+1) |

Fig.20B

| ITEM | INSTRUCTIONS |
|---|---|
| S120 | COMPUTE MIDPOINT g OF FIRST MAIN LINE AND MIDPOINT h OF SECOND MAIN LINE |
| S121 | COMPUTE MIDPOINT P OF FIRST SUBLINE AND MIDPOINT Q OF SECOND SUBLINE |
| S122 | COMPUTE POINT r ON PERPENDICULAR BISECTOR OF LINE SEGMENT PQ |
| S123 | COMPUTE LENGTH OF AUXILIARY MAIN LINE |
| S124 | LENGTH OF AUXILIARY MAIN LINE |
| S125 | DIVIDE FIRST MAIN LINE BY M AND STORE DIVISION POINTS u |
| S126 | DIVIDE SECOND MAIN LINE BY M AND STORE DIVISION POINTS w |
| S127 | DIVIDE AUXILIARY MAIN LINE BY 2M AND STORE ODD ONES v OF DIVISION POINTS |
| S128 | N ← 1 |
| S129 | COMPUTE CIRCULAR ARC eN CONTAINING END POINT a1 AND DIVISION POINTS vN AND wN |

Fig.20C

| ITEM | INSTRUCTIONS |
|---|---|
| S130 | STORE POSITION DATA OF END POINT a1, DIVISION POINTS vN AND wN, AND OTHER POINTS ON CIRCULAR ARC eN |
| S131 | COMPUTE CIRCULAR ARC e(N+1) CONTAINING DIVISION POINTS wN, v(N+1) AND u(N+1) |
| S132 | STORE POSITION DATA OF DIVISION POINTS v(N+1) AND u(N+1) AND OTHER POINTS ON CIRCULAR ARC e(N+1) |
| S133 | N ← (N+1) |
| S134 | IS w(N+1) PRESENT ? |
| S135 | COMPUTE CIRCULAR ARC e(N+1) CONTAINING DIVISION POINTS uN, v(N+1) AND w(N+1) |
| S136 | STORE POSITION DATA OF DIVISION POINTS v(N+1) AND w(N+1) AND OTHER POINTS ON CIRCULAR ARC e(N+1) |
| S137 | N ← (N+1) |
| S138 | COMPUTE CIRCULAR ARC e(N+1) CONTAINING DIVISION POINTS uN AND v(N+1) AND END POINT a4 |
| S139 | STORE POSITION DATA OF DIVISION POINT v(N+1), END POINT a4, AND OTHER POINTS ON CIRCULAR ARC e(N+1) |

Fig.21

SPT

| EMBROIDERY PATTERN No. | TYPE OF THE MAIN LINES | TYPE OF THE SUBLINES |
|---|---|---|
| SP1 | STRAIGHT LINE | STRAIGHT LINE |
| SP2 | STRAIGHT LINE | BROKEN LINE |
| SP3 | STRAIGHT LINE | BROKEN LINE |
| SP4 | CIRCULAR ARC | BROKEN LINE |
| SP5 | CIRCULAR ARC | CIRCULAR ARC |
| SP6 | CIRCULAR ARC | BROKEN LINE |
| SP7 | SPLINE CURVE | BROKEN LINE |
| SP8 | SPLINE CURVE | BROKEN LINE |
| SP9 | SPLINE CURVE | CIRCULAR ARC |
| SP10 | SPLINE CURVE | SPLINE CURVE |

Fig.23

LT1

| EMBROIDERY AREA No. | TYPE OF FIRST MAIN LINE | TYPE OF SECOND MAIN LINE | TYPE OF FIRST SUBLINE | TYPE OF SECOND SUBLINE | EMBROIDERY PATTERN No. |
|---|---|---|---|---|---|
| A1 | SPLINE CURVE | SPLINE CURVE | SPLINE CURVE | SPLINE CURVE | SP10 |
| A2 | SPLINE CURVE | STRAIGHT LINE | SPLINE CURVE | SPLINE CURVE | SP10 |
| A3 | STRAIGHT LINE | STRAIGHT LINE | STRAIGHT LINE | STRAIGHT LINE | SP1 |
| A4 | STRAIGHT LINE | STRAIGHT LINE | STRAIGHT LINE | DD (STRAIGHT LINE) | SP1 |
| A5 | SPLINE CURVE | STRAIGHT LINE | DD (BROKEN LINE) | BROKEN LINE | SP7 |
| A6 | SPLINE CURVE | SPLINE CURVE | BROKEN LINE | BROKEN LINE | SP7 |
| A7 | SPLINE CURVE | SPLINE CURVE | BROKEN LINE | DD (BROKEN LINE) | SP7 |
| A8 | SPLINE CURVE | SPLINE CURVE | DD (BROKEN LINE) | BROKEN LINE | SP7 |
| A9 | SPLINE CURVE | SPLINE CURVE | BROKEN LINE | BROKEN LINE | SP7 |
| A10 | SPLINE CURVE | SPLINE CURVE | BROKEN LINE | DD (BROKEN LINE) | SP7 |

Fig.28

LT2

| EMBROIDERY AREA No. | | TYPE OF FIRST MAIN LINE | TYPE OF SECOND MAIN LINE | TYPE OF FIRST SUBLINE | TYPE OF SECOND SUBLINE | EMBROIDERY PATTERN No. |
|---|---|---|---|---|---|---|
| B1 | | CIRCULAR ARC | CIRCULAR ARC | DD (CIRCULAR ARC) | CIRCULAR ARC | SP5 |
| B2 | | STRAIGHT LINE (CIRCULAR ARC) | CIRCULAR ARC | CIRCULAR ARC | CIRCULAR ARC | SP5 |
| B3 | | CIRCULAR ARC | CIRCULAR ARC | CIRCULAR ARC | CIRCULAR ARC | SP5 |
| B4 | | CIRCULAR ARC | CIRCULAR ARC | DD (STRAIGHT LINE) | DD (STRAIGHT LINE) | SP4 |
| B5 | | CIRCULAR ARC | CIRCULAR ARC | CIRCULAR ARC | CIRCULAR ARC | SP5 |
| B6 | | CIRCULAR ARC | CIRCULAR ARC | CIRCULAR ARC | CIRCULAR ARC | SP5 |
| B7 | B7a | STRAIGHT LINE | STRAIGHT LINE | STRAIGHT LINE (CIRCULAR ARC) | CIRCULAR ARC | SP5 |
| | B7b | SPLINE CURVE | SPLINE CURVE | CIRCULAR ARC | CIRCULAR ARC | SP9 |

STITCH DATA PREPARING DEVICE FOR EMBROIDERY SEWING MACHINE

BACKGROUND OF THE INVENTION

1. Field of the Invention

This invention relates to a stitch data preparing device for an embroidery sewing machine, and more particularly to a stitch data preparing device which freely sets the shape of an embroidery area in which embroidery stitches are formed, and forms embroidery stitches which properly reflect the shape of the embroidery area.

2. Description of Related Art

In Japanese Patent Publication No. 60-42740, for example, a conventional embroidery pattern storing and reproducing device is described which stores embroidery data for effecting embroidery stitching in a very small capacity memory. In this embroidery pattern storing and reproducing device, an embroidery zone such as a character or a figure is divided into a plurality of blocks. The embroidery area data, including block data defining an outline of each block and thread density data defining the number of stitches to be formed in each block by an embroidery thread, is also stored. Then, position data of the needle locations in each block is obtained based on the block data and the thread density data. Embroidery stitches are formed by a sewing machine using the position data of the needle locations.

In using the embroidery pattern storing and reproducing device to prepare the embroidery data, the embroidery zone is divided into a plurality of rectangular blocks. As shown in FIG. 30, in preparing embroidery area data for an embroidery zone 100 shaped, for example, like a leaf of a plant. A left half portion of the embroidery zone 100 is divided into three blocks B1, B2 and B3. A right half portion of the embroidery zone 100 is divided into an additional three blocks B4, B5 and B6. Then, the embroidery area data is created from the block data and the thread density data of the six blocks B1 to B6.

The block data of the block B1 comprises coordinates of four end points b11, b12, b13 and b14. The four end points define four outline segments L1, L2, L3 and L4 form the outline of the rectangular block B1. In other words, the block B1 is defined by a pair of first and second main line segments L1 and L2, which are opposed to each other and by a pair of first and second subline segments L3 and L4 connecting the first and second main lines L1 and L2 at each end. A plurality of needle locations are defined on the first and second main lines L1 and L2. In dividing an embroidery zone into a plurality of blocks, the number of divisions of the embroidery zone and the positions of divisions are generally determined based on the shape of the embroidery zone, so that a first subline and a second subline of a first block are generally straight line segments when the first block adjoins a second block.

Thus, an embroidery zone is divided into a plurality of rectangular blocks with the first and second sublines defined as straight line segments. The embroidery area data of each block is then created. Then, the stitch data defining the needle locations on the first and second main lines of each block is generated from the embroidery area data. FIG. 30 shows embroidery stitches formed according to the stitch data of the embroidery zone 200.

However, as the pair of sublines of each block are defined as straight line segments when preparing the embroidery area data, the shape of the block cannot be freely defined. Accordingly, in characters, symbols (including logos and marks) and figures (including animals, flowers, articles, etc.) having a complex shape including a curved portion or a sharply bent portion, the curved or sharply bent portion must be divided into many small blocks, in order to form the sublines as straight line segments. Accordingly, the number of blocks forming the entire embroidery zone is greatly increased, resulting in an increased quantity of the embroidery area data. In addition, creating the embroidery area data becomes vastly more complex.

Embroidery stitches are formed in each block. When the embroidery zone is divided into many small blocks, the shape of the embroidery zone cannot be properly reflected. That is, embroidery stitches along the shapes of the main lines and the sublines cannot be formed. In the arrangement of the six blocks B1 to B6 of the embroidery zone 200, as shown in FIG. 30, including adjacent blocks such as B1 and B4 or B2 and B5, the embroidery stitches are formed independently in these adjacent blocks. Accordingly, undesired spaces arise in the embroidery stitches between adjacent blocks, reducing the quality of the finished embroidery stitch pattern.

SUMMARY OF THE INVENTION

This invention provides a stitch data preparing device for an embroidery sewing machine which can greatly reduce the number of divisions of an embroidery area, allows the shape of the embroidery area to be freely set, and allows simple embroidery stitches reflecting the shape of the embroidery area to be formed.

According to this invention, a stitch data preparing device for an embroidery sewing machine prepares stitch data for forming embroidery stitches in an embroidery area. The embroidery area is defined by a pair of main lines as a pair of outline segments and opposed to each other and a pair of sublines as a pair of outline segments connecting the pair of main lines at each end. Thus, the stitches are turned back at a plurality of needle locations lying on the pair of main lines and are advanced from one end of each main line to the other end. The stitch data preparing device comprises: first storing means for storing a plurality of embroidery patterns and for storing a stitch data creation control routine corresponding to each embroidery pattern, second storing means for storing defining point data defining an outline of an embroidery area input from an external data source and for storing data of types of line segments forming the outline, line designating means for designating at least one of the main lines and the sublines for the embroidery area stored in the second storing means, and determining means for automatically determining an embroidery pattern for the embroidery area having at least one of the main lines and the sublines designated by the line designating means, according to the data stored in the first storing means and the second storing means. Each pattern is defined by the combination of a type of each main line and a type of each subline.

The first storing means stores a plurality of embroidery patterns, each pattern defined by a combination of a type of each of a pair of main lines and a type of each of a pair of sublines. The first storing means also stores a stitch data creation control routine corresponding to each embroidery pattern. Furthermore, the second storing means stores defining point data defining an outline of an embroidery area input from an external data source. The second storage means also stores data of types of outline segments used in forming the outline.

The line designating means designates at least one of the main lines and the sublines for the embroidery area stored in the second storing means. Then, the determining means automatically determines an embroidery pattern for the embroidery area having at least one of the main lines and the sublines designated by the line designating means, according to the data stored in the first storing means and the second storing means.

As described above, an optimum embroidery pattern for making embroidery stitches in an embroidery area input from the external data source is automatically determined according to the data of outline defining points, the types of line elements of the outline defining the input embroidery area, and at least one of the designated main lines and sublines. Accordingly, the shape of the embroidery area can be freely set without any limitation. Further, since the embroidery zone, which was required to be divided into a plurality of blocks in the prior art, can now be defined as a single embroidery area, the number of divisions of the embroidery area can be greatly reduced. In addition, since the number of divided embroidery areas is reduced, the number of gaps between adjacent embroidery areas can be reduced to realize a high-quality embroidery stitch pattern.

BRIEF DESCRIPTION OF THE DRAWINGS

A preferred embodiment of this invention will be described in detail with reference to the following figures, wherein:

FIG. 15 is a schematic flowchart of an embroidery pattern setting control routine;

FIGS. 17A and 17B are a schematic flowchart of a stitch data creation control routine for the second embroidery pattern;

FIGS. 18A and 18B are a schematic flowchart of a stitch data creation control routine for the third embroidery pattern;

FIGS. 19A and 19B are a schematic flowchart of a stitch data creation control routine for the fourth embroidery pattern;

FIGS. 20A–20C are a schematic flowchart of a stitch data creation control routinee for the fifth embroidery pattern;

FIG. 21 is an illustration showing the contents in an embroidery pattern table;

FIG. 23 is an illustration showing the contents in a line type table relating to the flower embroidery pattern;

FIG. 28 is an illustration showing the contents in a line type table relating to the fish embroidery pattern;

DETAILED DESCRIPTION OF THE PREFERRED EMBODIMENTS

Figure 1:
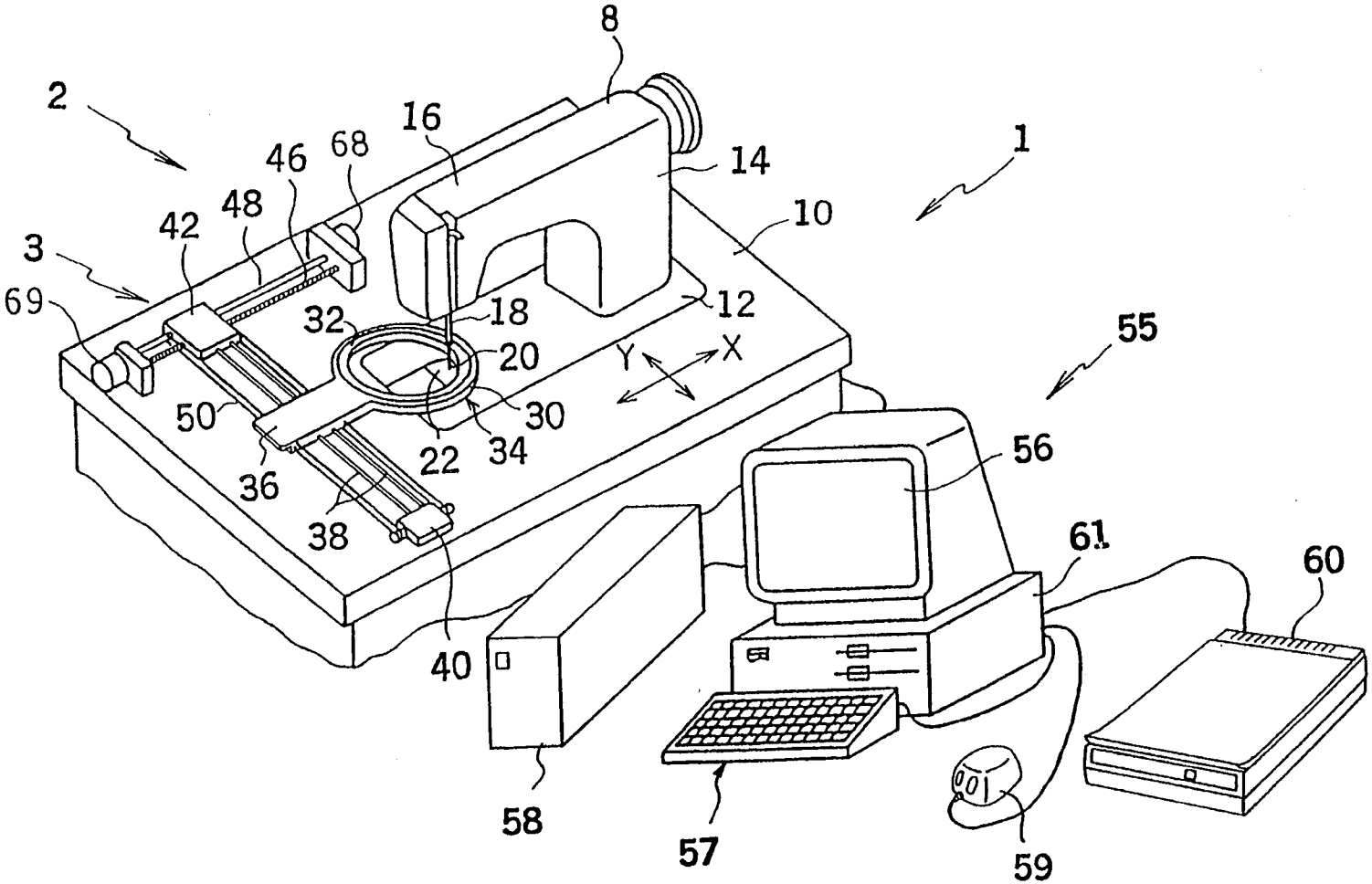
FIG. 1 is a schematic perspective view of an embroidery sewing apparatus.

Referring to FIG. 1, the embroidery sewing apparatus 1 comprises an embroidery unit 2 and a data processing unit 55 connected to the embroidery unit 2. The embroidery unit 2 includes an embroidery sewing machine 8 and a work fabric moving mechanism 3 for moving a work fabric (not shown) independently in an X-direction and a Y-direction.

Figure 2:
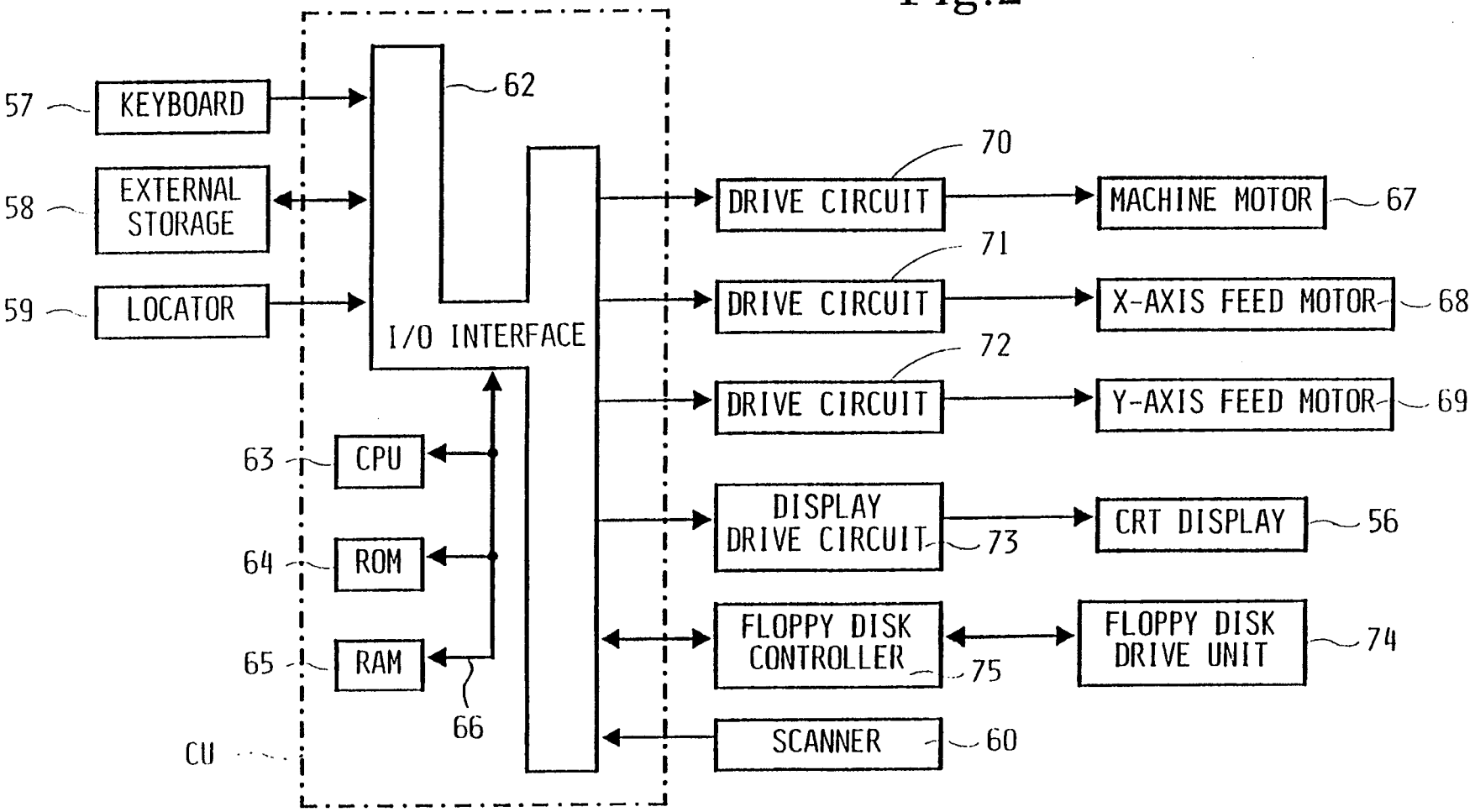
FIG. 2 is a block diagram of a control system for the embroidery sewing apparatus.

The embroidery sewing machine 8 and the work fabric moving mechanism 3 are mounted on a machine table 10. The embroidery sewing machine 8 includes a bed 12 mounted to the machine table 10, a pedestal 14 standing upright from one end of the bed 12 and an arm 16 extending over the bed 12 from the upper end of the pedestal 14. A needle bar driving mechanism (not shown) driven by a machine motor 67, shown in FIG. 2, is mounted in the arm 16. The needle bar driving mechanism vertically reciprocates a needle bar 18. A needle 20 is mounted to the lower end of the needle bar 18. An opening formed through the upper surface of the bed 12 is closed by a throat plate 22. The throat plate 22 is formed with a needle hole, the needle 20 being inserted through the needle hole. The needle 20 and a loop taker (not shown) provided in the bed 12 form the embroidery stitches.

The work fabric moving mechanism 3 includes an embroidery frame 34 provided on the machine table 10. The embroidery frame 34 comprises an outer ring 30 and an inner ring 32 fitted inside the outer ring 30. A slide portion 36 is integrally formed with and extends in the X-direction from the embroidery frame 34. A pair of guide pipes 38 support the slide portion 36 and extend in the Y-direction on the machine table 10. The slide portion 36 slides on the guide pipes 38 in the Y-direction.

The guide pipes 38 are fixed to a pair of supports 40 and 42. The support 42 is threadably engaged with an X-direction feed screw 46. The X-direction feed screw 46 extends in the X-direction. A rotational transmission shaft 48 is inserted through the support 42. An X-axis feed motor 68, such as a stepping motor, rotates X-direction feed screw 46 in a normal direction or a reverse direction. Accordingly, when the X-axis feed motor 68 rotates the X-direction feed screw 46, the embroidery frame 34 moves the X-direction.

A wire loop 50 is stretched between the supports 40 and 42. The wire loop 50 is attached to the slide portion 36. The rotational transmission shaft 48 rotates the wire loop 50 around the supports 40 and 42. One end of the rotational transmission shaft 48 is connected to a Y-axis feed motor 69, such as a stepping motor. Accordingly, when the rotational transmission shaft 48 rotates, the slide portion 36 moves in the Y-direction as the wire loop 50 rotates. As a result, the embroidery frame 34 moves to an arbitrary position on an X-Y plane on the machine table 10. Thus, an embroidery pattern is formed on a portion of the work fabric held between the outer ring 30 and the inner ring 32 of the embroidery frame 34.

As shown in FIG. 1, the data processing unit 55 comprises a CRT display 56, a keyboard 57, an external storage unit 58, such as a hard disk drive unit, a mouse 59, a scanner 60 and a control unit 61. The control unit 61 comprises a control unit 100 and a floppy disk drive unit 74 (see FIG. 2).

The control unit 100 comprises a CPU 63, the I/O interface 62, a ROM 64, and a RAM 65. The I/O interface 62, the ROM 64 and the RAM 65 are connected to the CPU 63 through a bus 66 such as a data bus. The ROM 64 stores a control program for stitch data creation. The RAM 65 includes an image memory for storing image data read from the scanner 60, an embroidery data memory for storing outline data read from the external storage unit 58, a thread density memory, a working memory and a memory for temporarily storing data generated by the CPU 63.

As shown in FIG. 2, the keyboard 57, the external storage 58, the mouse 59, a display drive circuit 73 for the CRT display 56, a floppy disk controller (FDC) 75 for the floppy disk drive unit (FDD) 74, and the scanner 60 are connected to the I/O interface 62 of the control unit 100. Further, a drive circuit 70 for the machine motor 67, a drive circuit 71 for the X-axis feed motor 68, and a drive circuit 72 for the Y-axis feed motor 69 are connected to the I/O interface 62.

The keyboard 57 allows an operator to input outline data defining an embroidery area of an embroidery pattern formed on the work fabric, input data of a stitch density of the embroidery pattern, etc. The keyboard 57 has keys representing alphabetic letters, numerals, symbols, etc. and various other keys necessary to input the outline data.

The external storage unit 58 stores outline data relating to embroidery patterns such as characters and figures. The outline data on the external storage unit 58 is associated with embroidery pattern numbers corresponding to the embroidery patterns. In an embroidery pattern comprising a number of embroidery areas, the outline data includes thread density data and data indicating the initial and terminal points of each line segment defining the outline of each area and the type (straight line, polygonal line of curved line) of each line segment.

The mouse 59 is used to control a pointer on the display 56. The mouse 59 can be any one of a mouse, a trackball, a light pen, a touch screen, a touch grid or the like, which is able to point to and select an object displayed on the display 56 by inputting a signal to the control unit 100.

Next, the creation of stitch data for ten types of embroidery patterns (first embroidery pattern SP1 to tenth embroidery pattern SP10) according to various shapes of embroidery areas will be described with reference to FIGS. 3 to 13. Each of the embroidery patterns SP1 to SP10 is defined by basic data, comprising data defining points of an outline for each embroidery area and pattern data designating the type of a pair of main lines (a first main line and a second main line) and the type of a pair of sublines (a first subline and a second subline). The main lines and sublines form the outline of each embroidery area. Accordingly, the pair of main lines are determined by four end points defined as two pairs of initial and terminal points of the main lines and the data of auxiliary points lying on the main lines and by the pattern data. The pair of sublines are determined by the pattern data.

Figure 3:
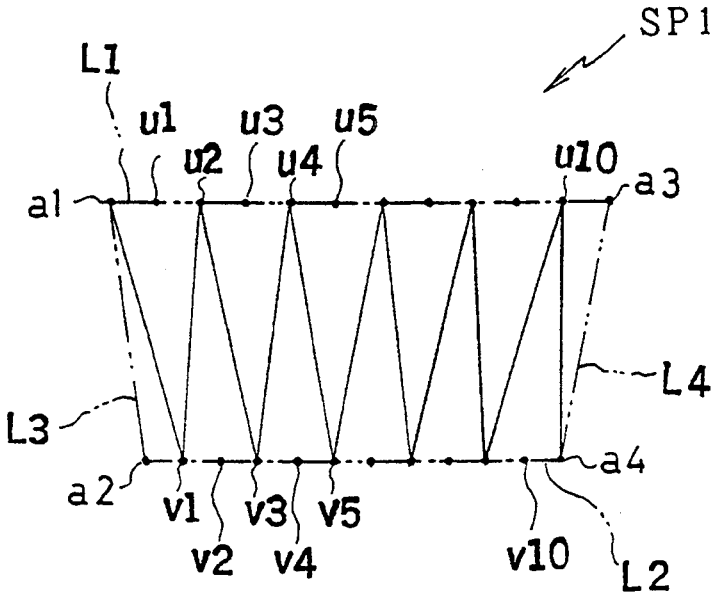
FIG. 3 is an illustration of a first embroidery pattern and embroidery stitches formed according to the first embroidery pattern using straight lines as the pair of main lines and straight lines as the pair of sublines.

FIG. 3 shows the first embroidery pattern SP1. The basic data of the first embroidery pattern comprises coordinates of four defining points, the four end points a1–a4, and pattern data designating a first main line L1 and a second main line L2 and a first subline L3 and a second subline L4. The lines L1–L4 are straight lines.

The first main line L1 is obtained by connecting the end point a1 and the end point a3. The second main line L2 is obtained by connecting the end point a2 and the end point a4. The first subline L3 is obtained by connecting the end point a1 and the end point a2. The second subline L4 is obtained by connecting the end point a3 and the end point a4. No auxiliary lines exists in this case. Accordingly, the method for obtaining the auxiliary main lines is omitted.

The needle locations are obtained as follows. The length of a line segment PQ, which connects a midpoint P of the first subline L3 and a midpoint Q of the second subline L4 is divided by a stitch pitch (stitch space) to obtain a division number M. The thread density determines the stitch pitch. The first main line L1 is divided by the division number M to obtain a plurality of division points u1–u10 extending from the end point a1 to the end point a3. The second main line L2 is also divided by the division number M to obtain a plurality of division points v1–v10 extending from the end point a2 to the end point a4.

The end point a1 is connected to the division point v1. The division point v1 is connected to the division point u2. Similarly, the even division points u2–u10 and the odd division points v3–v9 are alternately connected to each other. The last division point u10 is connected to end point a4. Thus, the needle locations of a V-shaped stitch pattern, as shown by the solid line L5 in FIG. 3, are generated.

Figure 4:
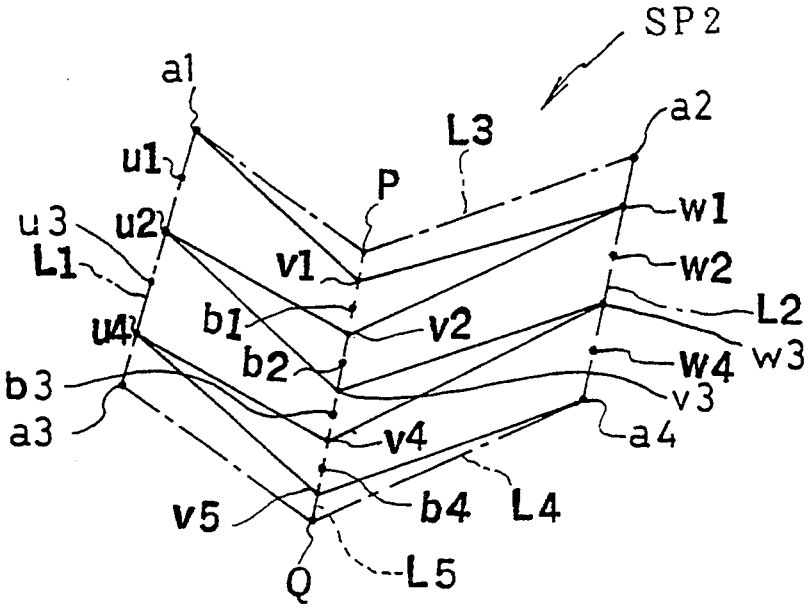
FIG. 4 is an illustration of a second embroidery pattern and embroidery stitches formed according to the third embroidery pattern using straight lines as the pair of main lines, polygonal lines as the pair of sublines, and a straight line as an auxiliary main line.

The second embroidery pattern SP2 is shown in FIG. 4. The basic data comprises coordinates of six defining points, comprising four end points, a1–a4, an auxiliary point P on the first subline L3 and an auxiliary point Q on the second subline L4. The basic data also comprises pattern data defining the first main line L1, the second main line L2, the first subline L3, the second subline L4 and an auxiliary main line L5. The lines L1, L2 and L5 are straight lines while the lines L3 and L4 are polygonal lines.

The first main line L1 is obtained by connecting the end point a1 and the end point a3. The second main line L2 is obtained by connecting the end point a2 and the end point a4. The first subline L3 is obtained by connecting the end point a1, the auxiliary point P and the end point a2. The second subline L4 is obtained by connecting the end point a3, the auxiliary point Q and the end point a4. The auxiliary point P is a breaking point of the first subline L3. The auxiliary point Q is a breaking point of the second subline L4. The auxiliary main line L5 is a line segment P-Q obtained by connecting the auxiliary points P and Q.

The needle locations are obtained as follows. The length of the auxiliary main line L5 is divided by the stitch pitch to obtain the division number M. The first main line L1 is divided by the division number M to obtain a plurality of division points u1–u4 extending from the end point al to the end point a3. The second main line L2 is divided by the division number M to obtain a plurality of division points w1–w4 extending from the end point a2 to the end point a4. The auxiliary main line L5 is divided by the division number M to obtain a plurality of division points b1–b4 extending from the auxiliary point P to the auxiliary point Q.

A plurality of intermediate division points, v1–v5, of line subsegments P-b1, b1-b2, b2-b3, b3-b4 and b4-Q of line segment P-Q are obtained, respectively, by assuming that the length $1_{a1\text{-}P}$ of the line segment a1-P is substantially equal to the length $l_{p\text{-}a2}$ of the line segment P-a2 and that the length $l_{a3\text{-}Q}$ of the line segment a3-Q is substantially equal to the length $l_{Q\text{-}a4}$ of the line segment Q-a4. The intermediate division points v1–v5 are obtained from the ratio of the length $l_{a1\text{-}P}$ of the line segment a1-P to the length $l_{p\text{-}a2}$ of the line segment P-a2 and the ratio of the length $l_{a3\text{-}Q}$ of the line segment a3-Q to the length $l_{Q\text{-}a4}$ of the line segment Q-a4.

The end point al is connected to the intermediate division point v1, which is in turn connected to the division point w1. The division point w1 is connected to the division point u2 through the division point v2. The division points u2, v3, w5, v4, u4, v5 and end point a4 are similarly connected. Thus, the needle locations for the embroidery pattern SP2 are obtained.

Figure 5:
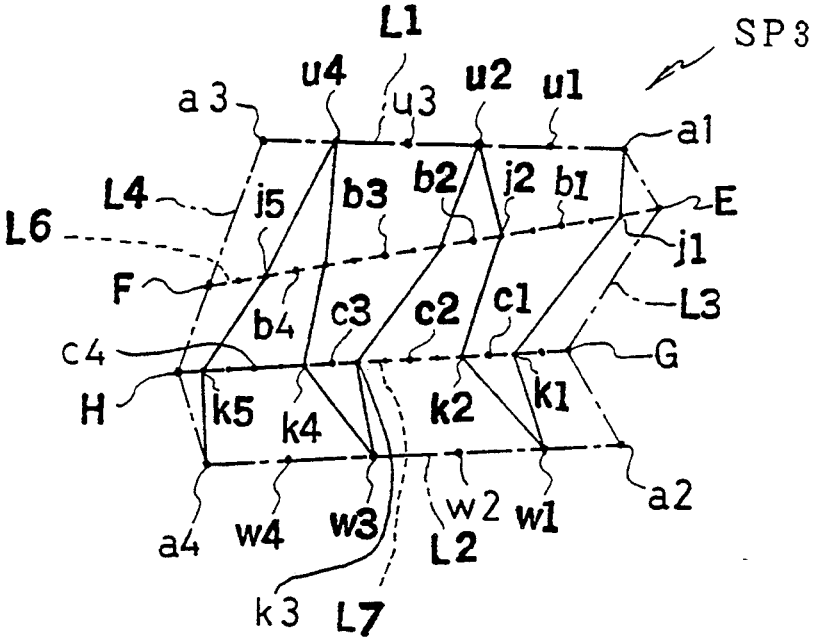
FIG. 5 is an illustration of a third embroidery pattern and embroidery stitches formed according to the fourth embroidery pattern using straight lines as the pair of main lines, polygonal lines as the pair of sublines, and straight lines as the pair of auxiliary main lines.

FIG. 5 shows the third embroidery pattern SP3. The basic data comprises coordinates of eight defining points, including four end points, a1–a4, two auxiliary points, E and G, on the first subline L3, and two auxiliary points, F and H, on the second subline L4. The basic data also comprises pattern data designating the first main line L1, the second main line L2, the first subline L3, the second subline L4, a first auxiliary main line L6, and a second auxiliary main line L7. The lines L1, L2, L6 and L7 are straight lines, while the lines L3 and L4 are polygonal lines.

The first main line L1 is obtained by connecting the end point al and the end point a3. The second main line L2 is obtained by connecting the end point a2 and the end point a4. The first subline L3 is obtained by connecting the end point a1, the auxiliary points E and G and the end point a2. The second subline L4 is obtained by connecting the end point a3, the auxiliary points F and H and the end point a4. The auxiliary points E and G are breaking points of the first subline L3. The auxiliary point H is a breaking point of the second subline L4. The location of the auxiliary point F satisfies the relation:

$$l_{a3\text{-}E}/l_{E\text{-}G}=l_{F\text{-}H}/l_{a3\text{-}F} \quad (1)$$

where $l_{a3\text{-}E}$ is the length of the line subsegment a3-E, $l_{E\text{-}G}$ is the length of the line segment, E-G, $l_{F\text{-}H}$ is the length of the line subsegment F-H, and $l_{a3\text{-}F}$ is the length of the line subsegment a3-F.

The first auxiliary main line L6 is obtained as the line segment E-F by connecting the auxiliary points E and F. The second auxiliary main line L7 is obtained as a line segment G-H by connecting the auxiliary points G and H.

The needle locations are obtained as follows. The average of the lengths of the first auxiliary main line L6 and the second auxiliary main line L7 is divided by the stitch pitch to obtain a division number M. The first main line L1 is divided by the division number M to obtain a plurality of division points u1–u4 extending from the end point a1 to the end part a3. The second main line L2 is divided by the division number M to obtain a plurality of division points w1–w4 extends from the end point a2 to the end point a4. The first auxiliary main line L6 is divided by the division number M to obtain a plurality of division points b1–b4 extending from the auxiliary point E to the auxiliary point F. The second auxiliary main line L7 is divided by the division number M to obtain a plurality of division points c1–c4 extending from the auxiliary point G to the auxiliary point H.

A plurality of intermediate division points j1–j5 of line subsegments E-b1 through b4-F of line segment E-F are obtained. A plurality of intermediate division points k1–k5 of line subsegments G-c1 to c4-H of line segment G-H are obtained. These division points are obtained by assuming that the lengths of six line segments a1-E, E-G, G-a2, a3-F, F-H and H-a4 are substantially equal to each other. The intermediate division points j1–j5 are obtained by trisecting each of the line subsegments E-b1 to b4-F and alternately selecting the $\frac{1}{3}$-division points and the $\frac{2}{3}$-division points. Similarly, the intermediate division points k1–k5 are obtained by trisecting each of the line segments G-c1 to c4-H and alternately selecting the $\frac{2}{3}$-division points and the $\frac{1}{3}$-division points of the line subsegments G-c1 to c4-H. Alternately, the intermediate division points j1–j5 and k1–k5 are obtained considering the ratio of the length $l_{a1\text{-}E}$ of the line segment a1-E to the length $l_{E\text{-}G}$ of the line segment E-G and the ratio of the length $l_{F\text{-}H}$ of the line segment F-H to the length $l_{a3\text{-}F}$ of the line segment a3-F.

The end point a1 is connected to the intermediate division point j1, which is connected to the intermediate division point k1, which is connected to the division point w1. In a manner similar to the first and second embroidery patterns SP1 and SP2, the division points w1, k2, j2, u2, j3, k3, w3 . . . to the end point a4 are sequentially connected to each other, thereby obtaining the needle locations.

Figure 6:
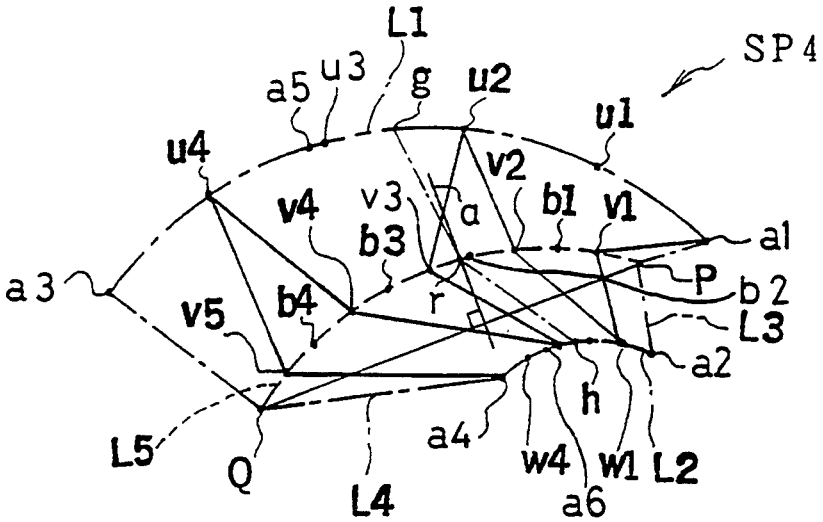
FIG. 6 is an illustration of a fourth embroidery pattern and embroidery stitches formed according to the fifth embroidery pattern using circular arcs as the pair of main lines, polygonal lines as the pair of sublines, and a circular arc as the auxiliary main line.

FIG. 6 shows the fourth embroidery pattern. The basic data comprises coordinates of eight defining points, the four end points a1–a4, an arbitrary auxiliary point a5 on the first main line L1, an arbitrary auxiliary point a6 on the second main line L2, an auxiliary point P on the first subline L3 and an auxiliary point Q on the second subline L4. The basic data also comprises pattern data defining the first main line L1, the second main line L2, the first subline L3, the second subline L4 and the auxiliary main line L5.

The first main line L1 is a circular arc obtained by connecting the end point a1, the auxiliary point a5 and the end point a3. The second main line L2 is a circular arc obtained by connecting the end point a2, the auxiliary point a6 and the end point a4. The first subline L3 is a polygonal line obtained by connecting the end point a1, the auxiliary point P and the end point a2. The second subline L4 is a polygonal obtained by connecting the end point a3, the auxiliary point Q and the end point a4.

The auxiliary point P is a breaking point of the first subline L3. The auxiliary point Q is a breaking point of the second subline L4. Further, it is assumed that the lengths of a line segment a1-P and a line segment P-a2 are substantially equal to each other, and that the lengths of a line segment a3-Q and a line segment Q-a4 are substantially equal to each other. The auxiliary main line L5 is a circular arc obtained by connecting the auxiliary point P, the point r and the auxiliary point Q.

The point g is the midpoint of the first main line L1. The point h is the midpoint of the second main line L2. The point r on a perpendicular bisector of the line segment P-Q is selected to satisfy the relation that the length $l_{g\text{-}r}$ of a line segment g-r equals the length $l_{r\text{-}h}$ of a line segment r-h. Alternately, the point r is selected to satisfy the relation:

$$l_{P\text{-}r}=l_{r\text{-}Q}; \text{ and} \quad (2)$$

$$l_{h\text{-}r}/l_{r\text{-}g}=\tfrac{1}{2}[(l_{P\text{-}a2}/l_{a1\text{-}P})+(l_{Q\text{-}a4}/l_{a3\text{-}Q})] \quad (3)$$

where $l_{p\text{-}r}$ is the length of the line segment P-r, $l_{r\text{-}Q}$ is the length of the line segment r-Q, $l_{h\text{-}r}$ is the length of the line segment h-r, $l_{r\text{-}g}$ is the length of the line segment r-g, $l_{p\text{-}a2}$ is the length of the line segment P-a2, $l_{a1\text{-}P}$ is the length of the line segment a1-P, $l_{Q\text{-}a4}$ is the length of the line segment Q-a4 and $l_{a3\text{-}Q}$ is the length of the line segment a3-Q.

The length of the auxiliary main line L5 is divided by the stitch pitch to obtain a division number M. The first main line L1 is divided by the division number M to obtain a plurality of division points u1–u4 extending from the end point a1 to the end point a3. The second main line L2 is divided by the division number M to obtain a plurality of division points w1–w4 extending from the end point a2 to the end point a4. The auxiliary main line L5 is divided by the division number M to obtain a plurality of division points b1–b4 extending from the auxiliary point P to the auxiliary point Q.

Assuming that the length $l_{a1\text{-}P}$ of the line subsegment a1-P is substantially equal to the length $l_{p\text{-}a2}$ of the line subsegment P-a2, and that the length $l_{a3\text{-}Q}$ of the line subsegment a3-Q is substantially equal to the length $l_{Q\text{-}a4}$ of the line subsegment Q-a4, a plurality of intermediate division points v1–v5 of line subsegments P-b to b4-Q are obtained. Alternately, the intermediate division points v1–v5 are obtained considering the ratio of the length $l_{a1\text{-}P}$ of the line subsegment a1-P to the length $l_{p\text{-}a2}$ of the line subsegment P-a2 and the ratio of the length $l_{a3\text{-}Q}$ of the line subsegment a3-Q to the length $l_{Q\text{-}a4}$ of the line subsegment Q-a4.

The end point a1 is connected to the intermediate division point v1, which is connected to the division point w1. Similarly, the division points w1, v2, u2, v3 . . . to the end point a4 are sequentially connected to each other, to obtain the needle locations.

Figure 7:
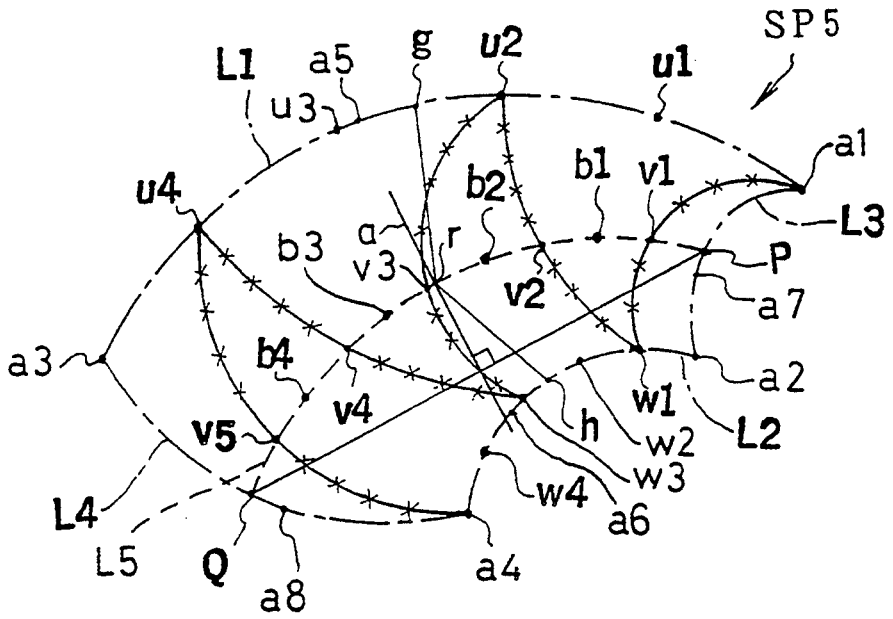
FIG. 7 is an illustration of a fifth embroidery pattern and embroidery stitches formed according to the sixth embroidery pattern using circular arcs as the pair of main lines, circular arcs as the pair of sublines, and a circular arc as the auxiliary main line.

FIG. 7 shows the fifth embroidery pattern SP5. The basic data comprises coordinates of eight defining points, the four end points, a1–a4, the arbitrary auxiliary point a5 on the first main line L1, the arbitrary auxiliary point a6 on the second main line L2, the arbitrary auxiliary point a7 on the first subline L3 and the arbitrary auxiliary point a8 on the second subline L4. The basic data also comprises pattern data defining circular arcs for the first main line L1, the second main line L2, the first subline L3, the second subline L4 and the auxiliary main line L5.

The first main line L1 is obtained by connecting the end point a1, the auxiliary point a5 and the end point a3. The second main line L2 is obtained by connecting the end point a2, the auxiliary point a6 and the end point a4. The first subline L3 is obtained by connecting the end point a1, the auxiliary point a7 and the end point a2. The second subline L4 is obtained by connecting the end point a3, the auxiliary point a8 and the end point a4. Like the fourth embroidery pattern SP4, the point g is the midpoint of the first main line L1 and the point h is the midpoint of the second main line L2. Further, the point P is the midpoint of the first subline L3 and the point Q is the midpoint is the of the second subline L4. The point r on a perpendicular bisector of the line segment P-Q is selected similarly to the fourth embroidery pattern SP4. As in the fourth embroidery pattern SP4, the auxiliary main line L5 is a circular arc connecting the auxiliary point P, the point r and the auxiliary point Q.

The division points u1–u4 on the first main line L1, division points w1–w4 on the second main line L2, division points b1–b4 on the auxiliary main line L5 and intermediate division points v1–v5 are obtained in a manner similar to that used in the fourth embroidery pattern SP4.

A circular arc is obtained by connecting the end point a1, the division point v1 and the division point w1. A plurality of auxiliary needle locations (shown by marks x in FIG. 7) lying on the circular arc at suitable intervals are obtained. Then, the end point a1, the auxiliary needle locations, the division point v1, the auxiliary needle locations and the division point w1 are connected together in this order to obtain needle points on this circular arc. Similarly, the division points w1, v2, u2, v3 . . . to the end point a4 are sequentially connected to each other. As in the circular arc connecting the points a1, v1 and w1, pluralities of auxiliary needle locations are determined. Thus, all of the needle locations are obtained.

Figure 8:
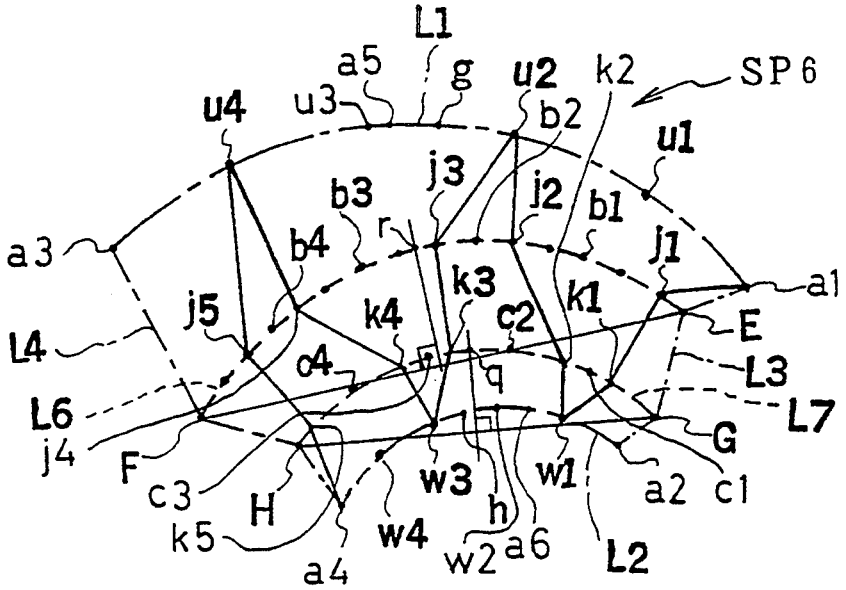
FIG. 8 is an illustration of a sixth embroidery pattern and embroidery stitches formed according to the seventh embroidery pattern using circular arcs as the pair of main lines, polygonal lines as the pair of sublines, and circular arcs as the pair of auxiliary main lines.

FIG. 8 shows the sixth embroidery pattern SP6. The basic data comprises coordinates of ten defining points, the four end points, a1–a4, the arbitrary auxiliary point a5 on the first main line L1, the arbitrary auxiliary point a6 on the second main line L2, the auxiliary points E and G on the first subline L3, and the auxiliary points F and H on the second subline L4. The basic data also comprises pattern data defining circular arcs for the first main line L1, the second main line L2, a first auxiliary main line L6 and a second auxiliary main line L7 and polygonal lines for the first subline L3 and the second subline L4.

The first main line L1 is obtained by connecting the end point a1, the auxiliary point a5 and the end point a3. The second main line L2 is obtained by connecting the end point a2, the auxiliary point a6 and the end point a4. The first subline L3 is obtained by connecting the end point a1, the auxiliary points E and G and the end point a2. The second subline L4 is obtained by connecting the end point a3, the auxiliary points E and H and the end point a4. The auxiliary points E and G are breaking points of the first subline L3, and the auxiliary points F and H are breaking points of the second subline L4.

Like the fourth embroidery pattern SP4, the point g is the midpoint of the first main line L1 and the point h is the midpoint of the second main line L2. Like the fourth embroidery pattern SP4, the point r on a perpendicular bisector of the line segment E-F and a point q on a perpendicular bisector of the line segment G-H are obtained. Like the fourth embroidery pattern SP4, the first auxiliary main line L6 is a circular arc and is obtained by connecting the auxiliary point E, the point r and the auxiliary point F. The second auxiliary main line L7 is a circular arc and is obtained by connecting the auxiliary point G, the point q and the auxiliary point H.

Like the third embroidery pattern SP3, the division points u1–u4 on the first main line L1 and division points w1–w4 on the second main line L2 are obtained. The division points b1–b4 on the first auxiliary main line L6 and division points c1-c4 on the second auxiliary main line L7 are similarly obtained. Then, the intermediate division points j1–j5 on the first auxiliary main line L6 and the intermediate division points k1–k5 on the second auxiliary main line L7 are obtained.

Alternately, the intermediate division points j1–j5 are obtained by considering the ratio of the length $l_{a1\text{-}E}$ of the line subsegment a1-E to the length $l_{E\text{-}G}$ of the line segment E-G and the ratio of the length $l_{a3\text{-}F}$ of the line segment a3-F to the length $l_{F\text{-}H}$ of the line segment F-H. Likewise the intermediate division points k1 to k5 are obtained by considering the ratio of the length $l_{E\text{-}G}$ of the line segment E-G to the length $l_{G\text{-}a2}$ of the line segment G-a2 and the ratio of the length $l_{F\text{-}H}$ of the line segment F-H to the length $l_{H\text{-}a4}$ of a line segment H-a4.

Like the third embroidery pattern SP3, the end point a1 through the division points j1 and k1 to the division point w1 are connected. Similarly, the division points w1, k2, j2, u2 . . . to the end point a4 are connected. Thus, the needle locations are obtained.

Figure 9:
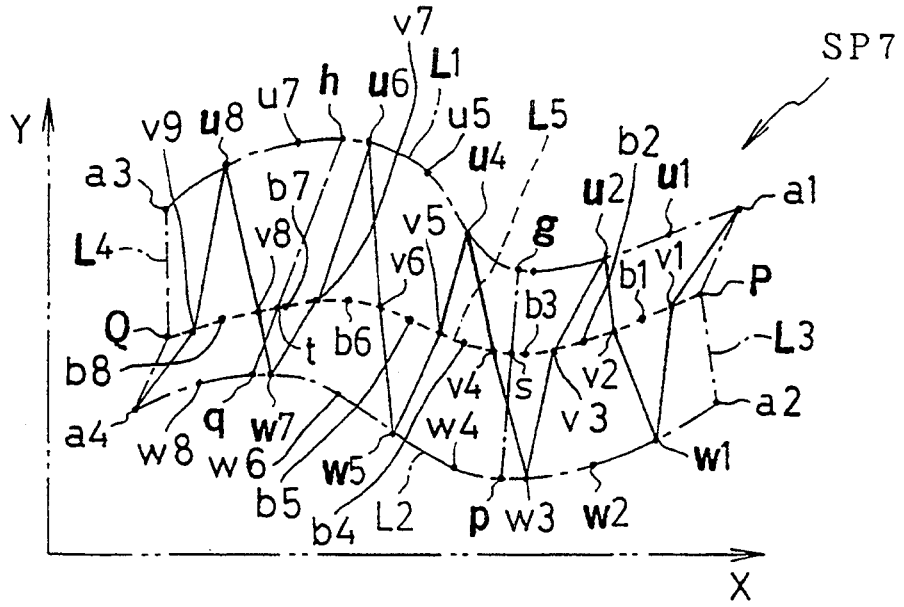
FIG. 9 is an illustration of a seventh embroidery pattern and embroidery stitches formed according thereto, using spline curves as the pair of main lines, polygonal lines as the pair of sublines, and a spline curve as the auxiliary main line.

FIG. 9 shows the seventh embroidery pattern SP7. The basic data comprises coordinates of ten defining points, the four end points, a1–a4, two auxiliary points g and h on the first main line L1, two auxiliary points p and q on the second main line L2, the auxiliary point P on the first subline L3 and the auxiliary point Q on the second subline L4. The basic data also comprises pattern data defining spline curves (free-form curves) for the first main line L1, the second main line L2 and the auxiliary main line L5 and polygonal lines for the first subline L3 and the second subline L4. The auxiliary points g and h are a Y-coordinate minimum point and a Y-coordinate maximum point, respectively, of the first main line L1 in an XY coordinate system. Similarly, the auxiliary points p and q are a Y-coordinate minimum point and a Y-coordinate maximum point, respectively, of the second main line L2 in the XY coordinate system.

The first main line L1 is obtained by using a predetermined function with the end points a1 and a3 and the auxiliary points g and h as variables. The second main line L2 is obtained by using a predetermined function with the end points a2 and a4 and the auxiliary points p and q as variables. The first subline L3 is obtained by connecting the end point a1, the auxiliary point P and the end point a2. The second subline L4 is obtained by connecting the end point a3, the auxiliary point Q and the end point a4.

Figure 10:
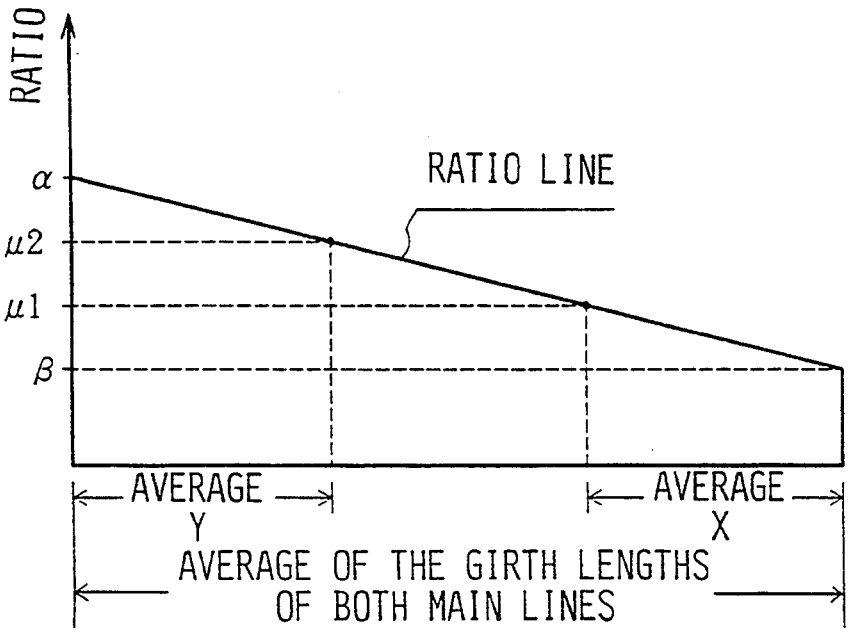
FIG. 10 is an illustration for obtaining defining points defining the shape of the auxiliary main line corresponding to the shape of the main lines in the seventh embroidery pattern.

As shown in FIG. 10, a ratio $\alpha$ and a ratio $\beta$ are obtained by:

$$\alpha = l_{a3\text{-}Q}/(l_{a3\text{-}Q} + l_{Q\text{-}a4}) \quad (4)$$

$$\beta = l_{a1\text{-}P}/(l_{a1\text{-}P} + l_{p\text{-}a2}) \quad (5)$$

where $l_{a3\text{-}Q}$ is the length of the line segment a3-Q, $l_{Q\text{-}a4}$ is the length of the line segment Q-a4, $l_{a1\text{-}P}$ is the length of the line segment a1-P, and $l_{p\text{-}a2}$ is the length of the line segment P-a2. Further, a ratio line is obtained by using the above two ratios $\alpha$ and $\beta$ and the average of the girth lengths of the main lines L1 and L2. A ratio $\mu 1$ corresponding to the average X of the girth lengths of arcs a1-g and a2-p is obtained by using the ratio line, and a ratio $\mu 2$ corresponding to the average Y of the girth lengths of arcs h-a3 and q-a4 is obtained by using the ratio line. The points s and t are obtained by satisfying the relation:

$$\mu 1 = l_{g\text{-}s}/l_{g\text{-}P} \quad (6)$$

$$\mu 2 = l_{h\text{-}t}/l_{h\text{-}g} \quad (7)$$

where $l_{g\text{-}s}$ is the length of the line segment g-s, $l_{g\text{-}p}$ is the length of the line segment g-P, $l_{h\text{-}t}$ is the length of the line segment h-t and $l_{h\text{-}g}$ is the length of a line segment h-g. The point s is a point on the line subsegment g-P and the point t is a point on the line subsegment h-g.

The auxiliary main line L5 is obtained by using a predetermined function with the auxiliary point P, the point s, the point t and the auxiliary point Q as variables. The length of the auxiliary main line L5 is divided by a stitch pitch to obtain a division number M. The first main line L1 is divided by the division number M to obtain a plurality of division points u1–u8 extending from the end point a1 to the end point a3. The second main line L2 is divided by the division number M to obtain a plurality of division points w1–w8 extending from the end point a2 to the end point a4. The auxiliary main line L5 is divided by the division number M to obtain a plurality of division points b1–b8 extending from the auxiliary point P to the auxiliary point Q. Considering the shapes of the first and second sublines L3 and L4, a plurality of intermediate division points v1–v9 of arc subsegments P-b1 to b8-Q are obtained, extending from the auxiliary point P to the auxiliary point Q.

Alternatively, the intermediate division points v1–v9 are obtained considering the ratio of the length $l_{a1\text{-}P}$ of the line segment a1-P to the length $l_{p\text{-}a2}$ of the line segment P-a2 and the ratio of the length $l_{a3\text{-}Q}$ of the line segment a3-Q to the length $l_{Q\text{-}a4}$ of the line segment Q-a4. The end point a1, the division point v1 and the division point w1 are connected together in this order. Similarly, the division points w1, v2, u2, v3, w3 . . . to the end point a4 are sequentially connected to each other, thus obtaining needle locations.

Figure 11:
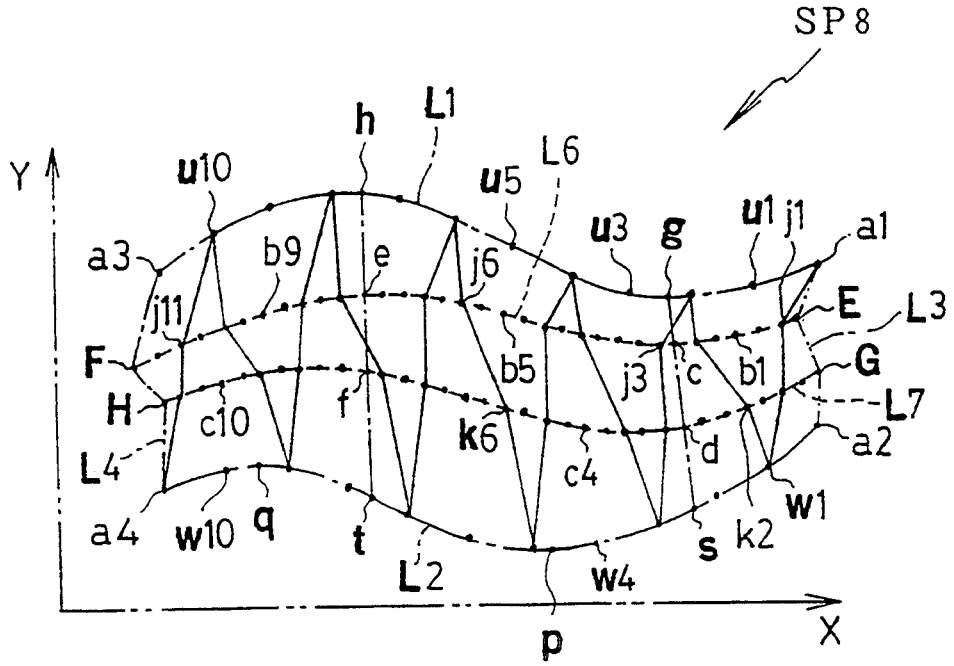
FIG. 11 is an illustration of an eighth embroidery pattern and embroidery stitches formed according to the eighth embroidery pattern using spline curves as the pair of main lines, polygonal lines as the pair of sublines, and spline curves as the pair of auxiliary main lines.

FIG. 11 shows the eighth embroidery pattern SP8. The basic data comprises coordinates of twelve defining points, the four end points a1–a4, two auxiliary points g and h on the first main line L1, two auxiliary points p and q on the second main line L2, two auxiliary points E and G on the first subline L3 and two auxiliary points F and H on the second subline L4. The basic data also comprises pattern data designating spline curves for the first main line L1, the second main line L2, a first auxiliary main line L6 and a second auxiliary main line L7 and polygonal lines for the first subline L3 and the second subline L4. Like the seventh embroidery pattern SP7, the auxiliary points g and h are the Y-coordinate minimum point and the Y-coordinate maximum point of the first main line L1, respectively. The auxiliary points p and q are the Y-coordinate minimum point and the Y-coordinate maximum point of the second main line L2, respectively.

The first main line L1 is obtained by using a predetermined function with the end point a1, the auxiliary points g and h and the end point a3 as variables. The second main line L2 is obtained by using a predetermined function with the end point a2, the auxiliary points p and q and the end point a4 as variables. The first subline L3 is obtained by connecting the end point a1, the auxiliary points E and G and the end point a2. The second subline L4 is obtained by connecting the end point a3, the auxiliary points F and H and the end point a4.

The points s and t on the second main line L2 are selected, which satisfy the relations:

$$G_{a1\text{-}P}/G_{L1}=G_{a2\text{-}s}/G_{L2} \quad (8)$$

$$G_{h\text{-}a3}/G_{L1}=G_{t\text{-}a4}/G_{L2} \quad (9)$$

where $G_{a1\text{-}g}$ is the girth length of the arc subsequent a1-g, $G_{L1}$ is the girth length of the first main line L1, $G_{a2\text{-}s}$ is the girth length of the arc subsequent a2-s, $G_{L2}$ is the girth length of the second main line L2, $G_{h\text{-}a3}$ is the girth length of the arc subsegment h-a3, and $G_{t\text{-}a4}$ is the girth length of the arc subsegment t-a4. It is assumed, for convenience of explanation, that:

$$l_{E\text{-}a2}=(l_{E\text{-}G}+l_{G\text{-}a2}); \text{ and} \quad (10)$$

$$l_{F\text{-}a4}=(l_{F\text{-}H}+l_{H\text{-}a4}) \quad (11)$$

where $l_{E\text{-}a2}$ is the length of the line segment E-a2, $l_{E\text{-}G}$ is the length of the line segment E-G, $l_{G\text{-}a4}$ is the length of the line segment G-a2), $l_{F\text{-}a4}$ is the length of the line segment F-a4, $l_{F\text{-}H}$ is the length of the line segment F-H, and $l_{H\text{-}a4}$ is the length of the line segment H-a4. Then, the point c on the line subsegment g-s and the point e on the line subsegment h-t are selected to satisfy the relations:

$$l_{a1\text{-}E}/l_{E\text{-}a2}=l_{g\text{-}c}/l_{c\text{-}s}; \text{ and} \quad (12)$$

$$l_{h\text{-}e}/l_{e\text{-}t}=l_{a3\text{-}F}/l_{F\text{-}a4} \quad (13)$$

where $l_{a1\text{-}E}$ is the length of the line segment a1-E, $l_{E\text{-}a2}$ is the length of the line segment E-a2, $l_{g\text{-}c}$ is the length of the line segment g-c, $l_{c\text{-}s}$ is the length of the line segment c-s, $l_{h\text{-}e}$ is the length of the line segment h-e, $l_{e\text{-}t}$ is the length of the line segment e-t, $l_{a3\text{-}F}$ is the length of the line segment a3-F, and $l_{F\text{-}a4}$ is the length of the line segment F-a4. However, the points c and e may be obtained by using a ratio line as described with respect to the seventh embroidery pattern SP7.

The first auxiliary main line L6 is obtained by using a predetermined function with the auxiliary point E, the points c and e and the auxiliary point F as variables. A point d on the line segment g-s and a point f on the line segment h-t are obtained in the same manner as the points c and e. The second auxiliary main line L7 is obtained by using a predetermined function with the auxiliary point G, the points d and f and the auxiliary point H as variables. However, the points d and f may be obtained by using a ratio line as mentioned in the seventh embroidery pattern SP7.

Like the third embroidery pattern SP3, division points u1–10 on the first main line L1 and division points w1–w10 on the second main line L2 are obtained. Then, division points b1–b10 on the first auxiliary main line L6 and division points c1–c10 on the second auxiliary main line L7 are obtained. Then, intermediate division points j1–j11 on the first main line L6 and intermediate division points k1–k11 on the second main line L7 are obtained. However, the intermediate division points j1–j11 and k1–k11 may be obtained considering the ratio in length among the line segments a1-E, E-G and G-a2, and the ratio in length among the line segments a3-F, F-H and H-a4, respectively.

The end point a1, the intermediate division points j1 and k1 and the division point w1 are connected together in this order. Similarly, the division points w1, k1, j1, u2, j2, k2 . . . to the end point a4 are connected to each other, thus obtaining the needle locations.

Figure 12:
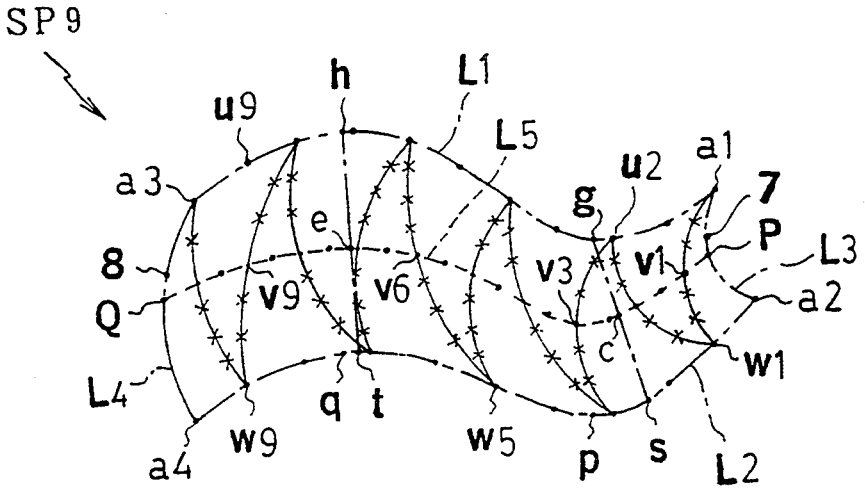
FIG. 12 is an illustration of a ninth embroidery pattern and embroidery stitches formed according to the ninth embroidery pattern using spline curves as the pair of main lines, circular arcs as the pair of sublines, and a spline curve as the auxiliary main line.

FIG. 12 shows the ninth embroidery pattern SP9. The basic data comprises coordinates for ten defining points, the four end points a1–a4, two auxiliary points g and h on the first main line L1, two auxiliary points p and q on the second main line L2, an arbitrary auxiliary point a7 on the first subline L3 and an arbitrary auxiliary point a8 on the second subline L4. The basic data also comprises pattern data designating spline curves for the first main line L1, the second main line L2 and an auxiliary main line L5 and circular arcs for the first subline L3 and the second subline L4. Like the eighth embroidery pattern SP8, the auxiliary points g and h are the Y-coordinate minimum point and the Y-coordinate maximum point of the first main line L1, respectively.

The auxiliary points p and q are the Y-coordinate minimum point and the Y-coordinate maximum point of the second main line L2, respectively. Like the eighth embroidery pattern SP8, the first main line L1 and the second main line L2 are obtained. The first subline L3 is obtained by connecting the end point a1, the auxiliary point a7 and the end point a2, and the second subline L4 is obtained by connecting the end point a3, the auxiliary point a8 and the end point a4. A midpoint P of the first subline L3 and a midpoint Q of the second subline L4 are obtained. Like the eighth embroidery pattern SP8, two points s and t on the second main line L2, the point c on the line segment g-s and the point e on a line segment h-t are obtained. The auxiliary main line L5 is obtained by using a predetermined function with the auxiliary point P, the points c and e and the auxiliary point Q as variables.

Like the fifth embroidery pattern SP5, division points u1–u9 on the first main line L1, division points w1–w9 on the second main line L2 and division points b1–b9 on the auxiliary main line L5 are obtained. Then, intermediate division points v1–v10 on the auxiliary main line L5 are obtained.

A circular arc is obtained by connecting the end point a1, the division point v1 and the division point w1, and a plurality of auxiliary needle locations (shown by marks x in FIG. 12) lying on this circular arc at suitable intervals are obtained. Then, the end point a1, the auxiliary needle locations, the division point v1, the auxiliary needle locations and the division point w1 are connected together in this order to obtain needle locations on this circular arc. Similarly, the division points w1, v2, u2, v3 . . . to the end point a4 are connected to each other along with the corresponding auxiliary needle locations, thus obtaining all the needle locations.

Figure 13:
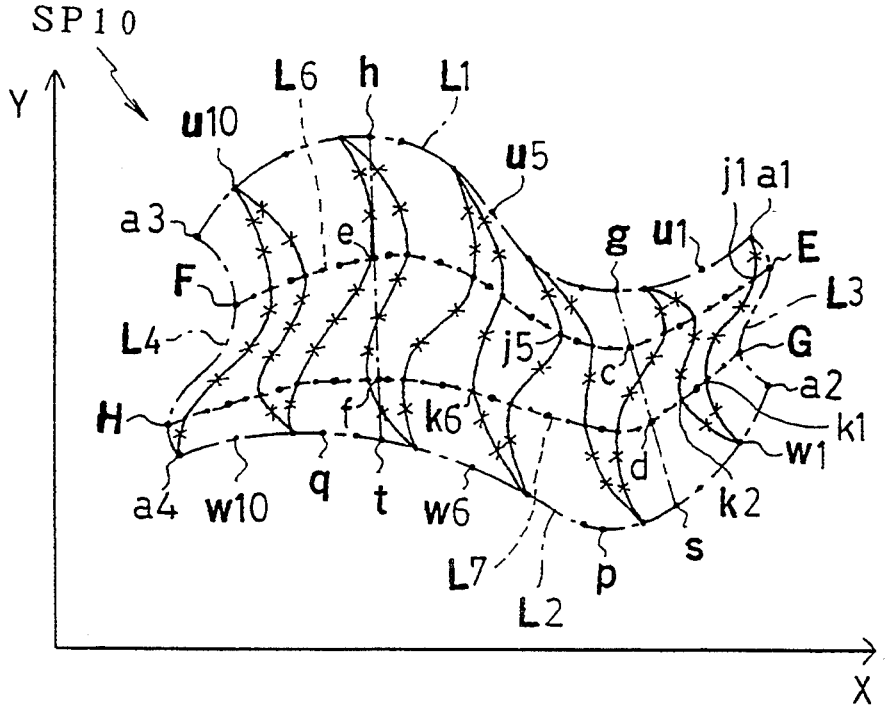
FIG. 13 is an illustration of a tenth embroidery pattern and embroidery stitches formed according to the tenth embroidery pattern using spline curves as the pair of main lines, spline curves as the pair of sublines, and spline curves as the pair of auxiliary main lines.

FIG. 13 shows the tenth embroidery pattern SP10. The basic data comprises coordinates for twelve defining points, the four end points a1–a4, two auxiliary points g and h on the first main line L1, two auxiliary points p and q on the second main line L2, two auxiliary points E and G on the first subline L3 and two auxiliary points F and H on the second subline L4. The basic data also comprises pattern data designating spline curves for the first main line L1, the second main line L2, the first auxiliary main line L6, the second auxiliary main line L7, the first subline L3 and the second subline L4.

Like the ninth embroidery pattern SP9, the auxiliary points g and h are the Y-coordinate minimum point and the Y-coordinate maximum point of the first main line L1, respectively. The auxiliary points p and q are the Y-coordinate minimum point and the Y-coordinate maximum point of the second main line L2, respectively. Further, the auxiliary point E is an X-coordinate maximum point of the first subline L3 in the XY coordinate system. The auxiliary point G is an X-coordinate minimum point of the first subline L3. Similarly, the auxiliary point F is an X-coordinate maximum point and the auxiliary point H is an X-coordinate minimum point of the X-coordinates of the second subline L4.

Like the ninth embroidery pattern SP9, the first main line L1 and the second main line L2 are obtained. The first subline L3 is obtained from the end point a1, the auxiliary points E and G and the end point a2. The second subline L4 is obtained from the end point a3, the auxiliary points F and H and the end point a4. Like the eighth embroidery pattern SP8, two points s and t on the second main line L2, two points c and d on the line segment g-s, and two points e and f on the line segment h-t are obtained. Then, the first auxiliary main line L6 and the second auxiliary main line L7 are obtained.

Like the eighth embroidery pattern SP8, division points u1–u10 on the first main line L1, division points w1–w10, division points b1–b10 on the first auxiliary main line L6 and division points c1–c10 on the second auxiliary main line L7 are obtained. Then, intermediate division points j1–j11 on the first auxiliary main line L6 and intermediate division points k1–k11 on the second auxiliary main line L7 are obtained.

Similarly to the eighth embroidery pattern SP8, a spline curve is obtained from the end point a1, the division points j1, k1 and w1. A plurality of auxiliary needle locations (shown by marks x in FIG. 13) lying on this spline curve at suitable intervals are also obtained. Then, the end point a1, the auxiliary needle locations, the division point j1, the auxiliary needle locations, the division point k1, the auxiliary needle locations and the division point w1 are connected together in this order to obtain needle locations on this spline curve. Similarly, the division point w1, k2, j2, u2, k3, j3 . . . to the end point a4, along with the auxiliary needle locations, are connected to each other, thereby obtaining all needle locations.

A stitch data creation control routine is shown by the flowcharts shown in FIGS. 14 to 20. In the following description, the control will be applied to the first through the fifth embroidery patterns, SP1 to SP5, for convenience of explanation. The description of the control routines for the sixth to tenth embroidery patterns SP6 to SP10 will be omitted. However, the ROM 64 stores an embroidery pattern table SPT, shown in FIG. 21, in which the first to tenth embroidery patterns SP1 to SP10 are associated with the types of the main lines and the types of the sublines.

Figure 14:
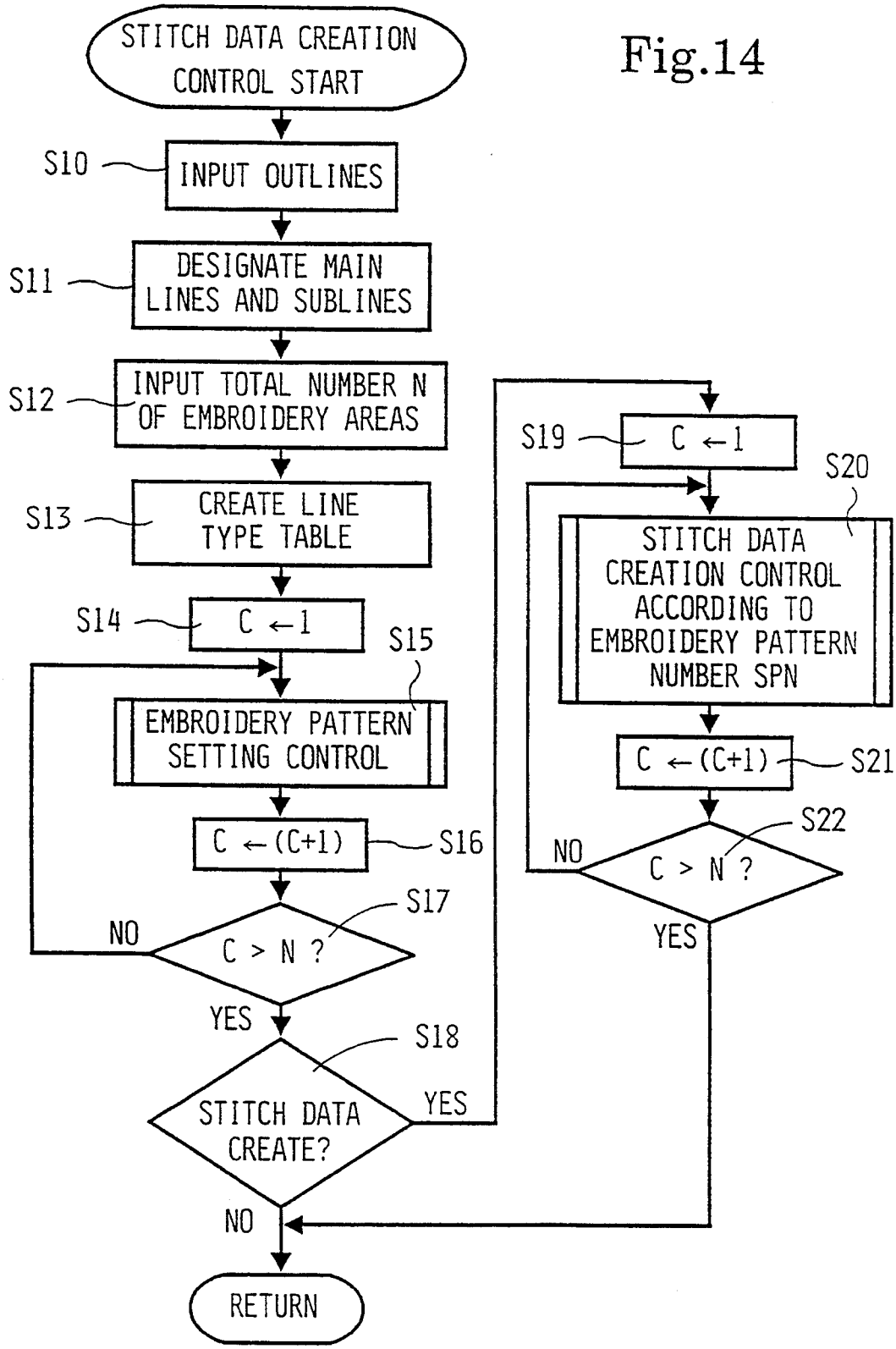
FIG. 14 is a schematic flowchart of a stitch data creation control routine.

Referring to FIG. 14, when the keyboard 57 is operated to create stitch data, the CRT display outputs a prompt for the entry of outline data defining the embroidery pattern. An initial point and a terminal point as end points of each line segment of the outline are designated using the mouse 57. The type of each line segment is designated using the keyboard 57. Accordingly, the outlines just input are sequentially displayed on the CRT display 56 (S10). The type of each line segment, i.e., straight line, circular arc, broken line and spline curve, is designated. In designating any type of line other than a straight line, a plurality of outline defining points extending from the initial point to the terminal point are designated.

Figure 22:
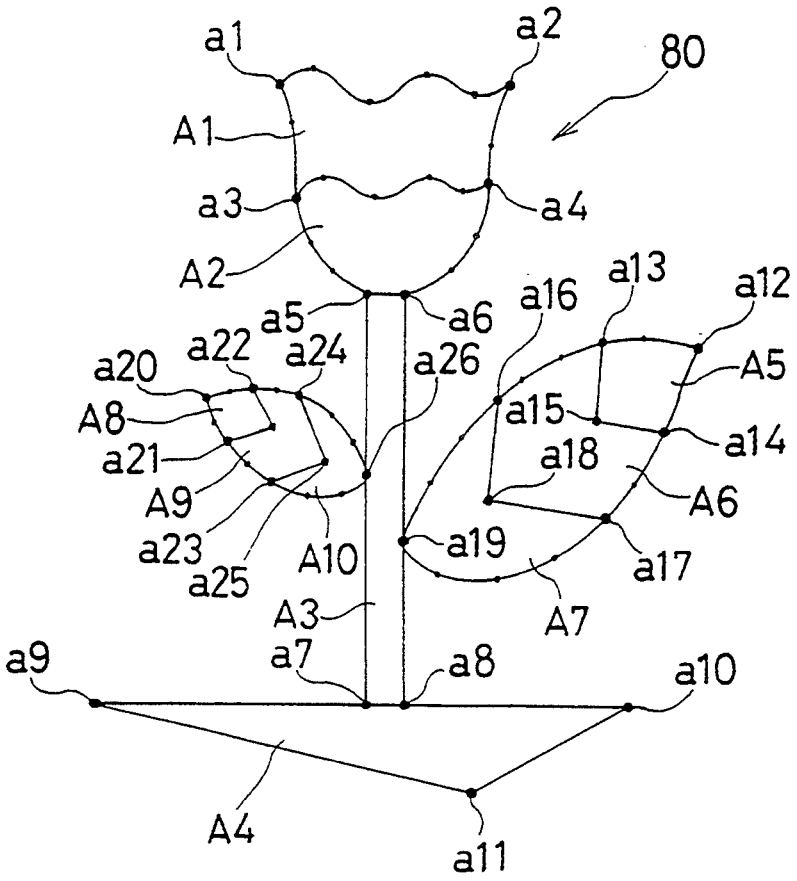
FIG. 22 is an illustration of embroidery areas constituting a flower embroidery pattern.
Figure 24:
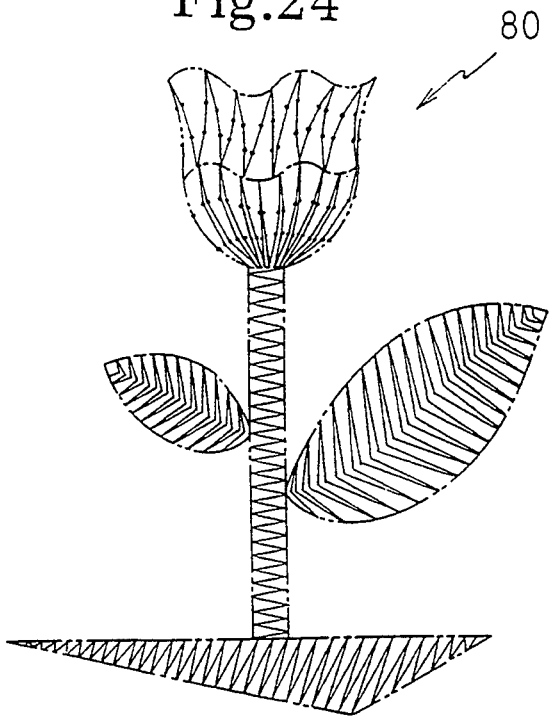
FIG. 24 is an illustration of embroidery stitches formed in the embroidery areas of the flower embroidery pattern.

When an embroidery pattern comprises a plurality of embroidery areas, outline data for each embroidery area is input. For example, as shown in FIG. 22, a flower embroidery pattern 80 comprises ten embroidery areas A1–A10. In this example, outline data is input for each embroidery area A1–A10. Simultaneously, the type of each line segment of the outline is input. For example, end points a1, a2, a3 and a4 and the other defining points are input for the embroidery area A1. End points a3, a4, a5 and a6 and the other defining points are input for the embroidery area A2. Similarly, the other end points up to an end point a26 and the other defining points are input for the embroidery areas A3–A10.

Then, the mouse 59 is operated to designate the line elements of each outline displayed on the CRT display 56. The keyboard 57 is operated to designate the first main line, the second main line, the first subline, and the second subline of each outline (S11). Then, the keyboard 57 is operated to designate a number N indicative of the total number of embroidery areas of the embroidery pattern 80 (S12). Then, embroidery area numbers are associated with the types of the main lines and the sublines designated in the order of entry of the outlines, to create a line type table and to store the line type table into the working memory of the RAM 65 (S13).

For example, in the embroidery areas A1–A10 of the flower embroidery pattern 80 shown in FIG. 22, a line type table LT1, as shown in FIG. 23 is created and stored in the working memory. In the line type table, each embroidery area, A1–A10 is associated with the types of the first main line, the second main line, the first subline and the second subline. However, the lines corresponding to the second subline of the embroidery area A4, the first subline of the embroidery area A5, the second subline of the embroidery area A7, the first subline of the embroidery area A8 and the second subline of the embroidery area A10 do not exist. Instead, dot data DD is automatically stored.

Then, an initial value "1" is set as a count value C of an area counter for counting the embroidery areas (S14). An embroidery pattern setting control (see FIG. 15) is then executed according to this area count value C (S15).

Referring to FIG. 15, when the embroidery pattern setting control is started, the line type data of the first subline and the second subline is determined according to the line type table LT1 stored in the working memory (S25). If one of the two sublines (initial subline) has straight line data or dot data DD, and the other subline does not have either straight line data or dot data DD (S26: Yes; S32: No), the line type data of the other subline is stored as the line type data of the initial subline (S33). Then the program proceeds to S27. However, if both the first and second sublines have straight line data or dot data DD (S26, S32: Yes), the straight line data is stored as the line type data of both the sublines (S34). Then the program again proceeds to S27.

On the other hand, if neither subline has straight line data or dot data DD (S26: No), the line type data of the first main line and the second main line is determined according to the line type table LT1 stored in the working memory (S27). If one of the main lines (an initial main line) has straight line data or dot data DD, and the other main line does not have either straight line data or dot data DD (S28: Yes; S29: No), the line type data of the other main line is stored as the line type data of the initial main line (S30). Then the program proceeds to S35. However, if both the first and second main lines have straight line data or dot data DD (S28, S29: Yes), the straight line data is stored as the line type data of both the main lines (S31). Then the program again proceeds to S35. For example, as shown in FIG. 23, dot data DD of the initial subline (the first subline or the second subline) is changed into the line type data of the other subline. This changed line type data is then stored.

Then, a common one of the line type data of both the main lines is taken as a representative line type data. A common one of the line type data of both sublines is taken as representative line type data according to the line type table LT1 shown in FIG. 23 (S35). However, in the combination of an spline curve and a straight line, the spline curve is taken as the representative line type data. For example, for the embroidery area number A1, a spline curve is taken as the representative line type data of both the main lines. A spline curve is also taken as the representative line type data of both sublines. Further, for the embroidery area number A5, a spline curve is taken as the representative line type data of both main lines. A polygonal line is taken as the representative line type data of both sublines.

Then, based on the embroidery pattern table SPT, the representative line type data of both main lines and the representative line type data of both sublines, an embroidery pattern number is determined, stored into the line type table LT1 to correspond to the embroidery area number (S36). For example, for the embroidery area number A1, the representative line type data of both main lines is a spline curve. The representative line type data of both sublines is also a spline curve. Thus, the embroidery pattern number SP10 is determined according to the embroidery pattern table SPT. Then, control proceeds to step S16 in the stitch data creation control routine shown in FIG. 14.

In step S16, the area count value C is incremented by 1. If the current value C is not greater than the total number N of the embroidery areas (S17: No), steps S15 to S17 are repeated. However, if embroidery pattern numbers are correspondingly set for all of the embroidery areas, (S17: Yes), and if the creation of stitch data is commanded (S18: Yes), then the area count value C is reset to one (S19). Then, a stitch data creation control routine (see FIGS. 16 to 20C) is executed according to the current value of C (S20).

First, the stitch data creation control routine executed when the first embroidery pattern SP1 is selected (see FIG. 16) is described with reference to FIG. 3.

Figure 16:
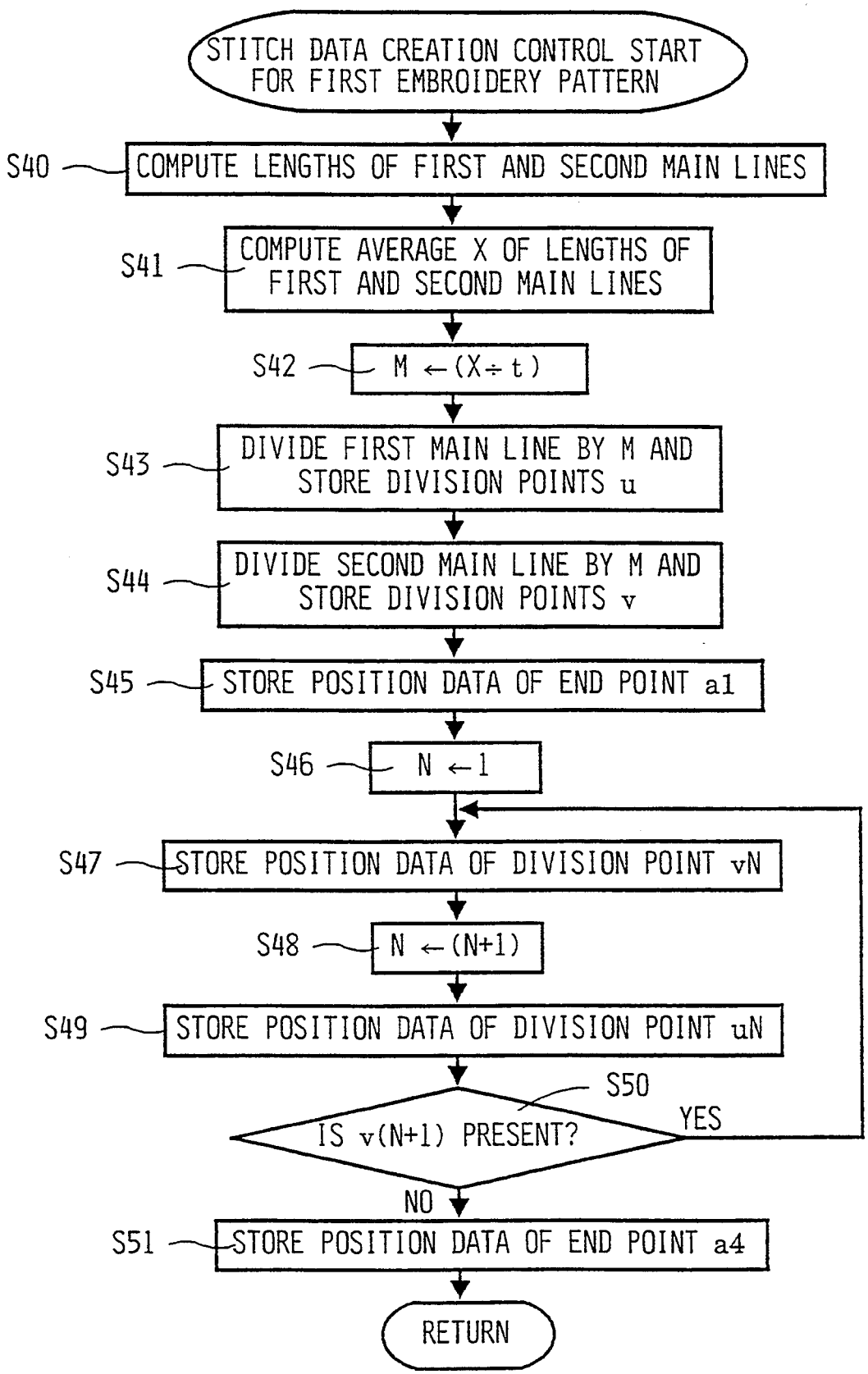
FIG. 16 is a schematic flowchart of a stitch data creation control routine for the first embroidery pattern.

Referring to FIGS. 3 and 16, the lengths of the first main line L1 and the second main line L2 are determined according to the position data of the end points a1–a4 (S40). The average X of the lengths of the first main line L1 and the second main line L2 is determined (S41). The average X is then divided by a stitch pitch t, determined by a thread density, to obtain a division number M (S42). However, if the division number M is an even number, "1" is added to the division number M to make M odd. Then, the first main line L1 is divided by the division number M to obtain division points u1–u(M−1), which are stored into a position data buffer in the RAM 65 sequentially from the end point a1 (S43). Similarly, the second main line L2 is divided by the division number M to obtain division points v1–v(M−1), which are stored into the position data buffer sequentially from the end point a2 (S44).

Then, the position data of the end point a1 is stored into the position data buffer (S45). A position counter value N is initially set to one (S46). The position data of the division point v(N) is stored into the position data buffer (S47). Then, the position counter value N is incremented by 1 (S48). The position data of the division point u(N) is stored into the position data buffer (S49).

Then, if the division point v(N+1) is present (S50: Yes), steps S47 to S50 are repeated. On the other hand, if the division point v(N+1) does not exist (S50: No), the position data of the end point a4 is stored into the position data buffer (S51). Then, controls returns to step S21 in the stitch data creation routine control shown in FIG. 14.

Secondly, the stitch data creation control executed when the second embroidery pattern SP2 is selected (see FIGS. 17A–17B) is described with reference to FIG. 4.

Figure 17A:
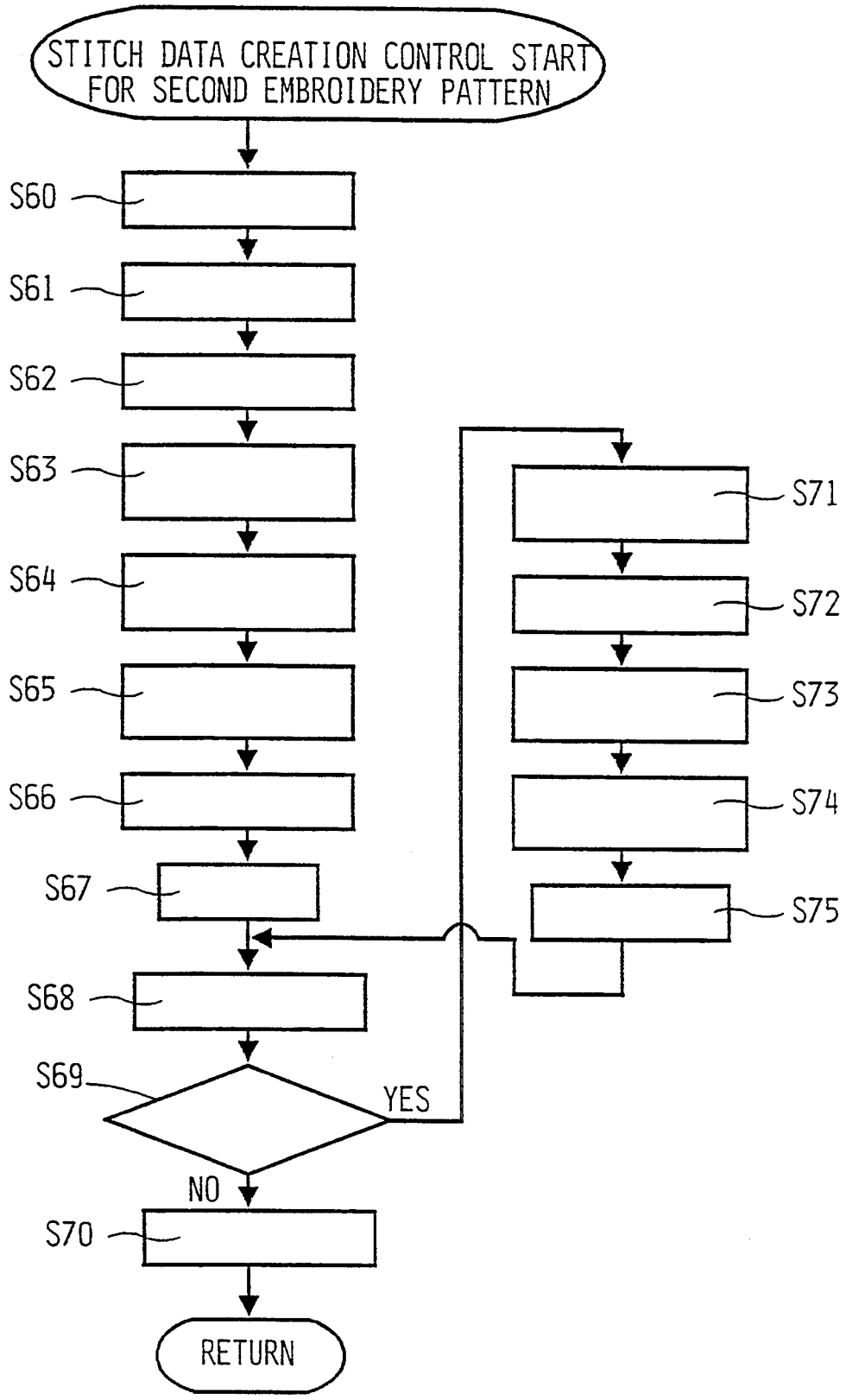

Referring to FIGS. 4 and 17A–17B, the lengths of the first main line L1 and the second main line L2 are determined (S60). The length of the auxiliary main line L5 is determined (S61). Then, the length of the auxiliary main line L5 is divided by a stitch pitch t to obtain a division number M (S62). However, if the division number M is an even number, "1" is added to the division number M to make M odd. Then, the first main line L1 is divided by the division number M to obtain division points u1–u(M−1), which are stored into the position data buffer sequentially from the end point a1 (S63). The second main line L2 is divided by the division number M to obtain division points w1–w(M−1), which are stored into the position data buffer from the end point a2 (S64). Then, the auxiliary main line L5 is divided by twice the division number, 2M, to obtain division points v1–v(2M−1). Odd ones v1, v3, . . . , v(2M−1)) of these division points v1–v(2M−1) are stored into the position data buffer sequentially from the auxiliary point P (S65).

Then, the position data of the end point a1 is stored into the position data buffer (S66). The position counter value N is initially set to one (S67). The position data of the division point v(N) is stored into the position data buffer (S68). If the division point v(N+1) is present (S69: Yes), the position data of the division point w(N) is stored into the position data buffer (S71). The position counter value N is incremented by 1 (S72). Then, the position data of the division point v(N) and the position data of the division point u(N) are stored into the position data buffer (S73, S74). The position counter value N is again incremented by 1 (S75). Then, steps S68 to S75 are repeated. However, if the division point v(N+1) does not exist, (S69: No), the position data of the end point a4 is stored into the position data buffer (S70). Then, this control returns to step S21.

Thirdly, the stitch data creation control routine executed when the third embroidery pattern SP3 is selected (see FIGS. 18A–18B) is described with reference to FIG. 5.

Figure 18A:
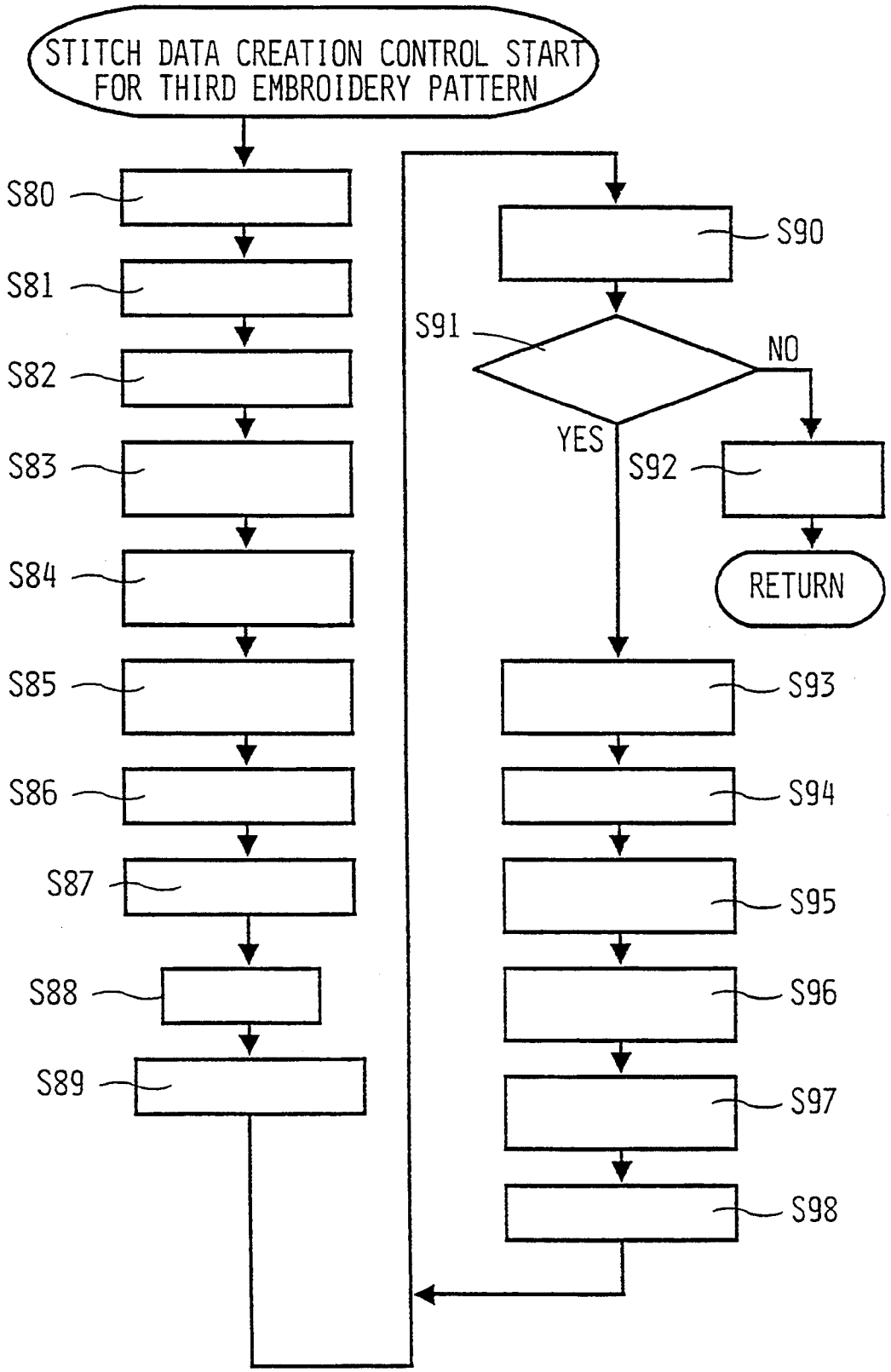

Referring to FIGS. 5 and 18A–18B, the lengths of the first main line L1 and the second main line L2 are determined. The lengths of the first auxiliary main line L6 and the second auxiliary main line L7 are determined (S80). The average X of the lengths of the first and second auxiliary main lines L6 and L7 is determined (S81). The average X is then divided by a stitch pitch t to obtain a division number M (S82). However, if the division number M is an even number, "1" is added to the division number M to make M odd. The first main line L1 is divided by the division number M to obtain division points u1–u(M−1) which are stored into the position data buffer sequentially from the end point a1 (S83). Similarly, the second main line L2 is divided by the division number M to obtain division points w1–w(M−1), which are stored into the position data buffer sequentially from the end point a2 (S84). The first auxiliary main line L6 is divided by three times the division number, 3M, to obtain division points x1–x(3M). Of these division points, the x(3n) division points (where n is a positive integer) and the even division points x(2n) are removed to leave division points (j1–j(M+1), which are stored into the position data buffer sequentially from the auxiliary point E (S85). Similarly, the second auxiliary main line L7 is divided by three times the division number, 3M, to obtain division points x1–x(3M). Of these division points, the x(3n) division points and the odd division points x(2n+1) are removed to leave division points k1–k(M+1), which are stored into the position data buffer sequentially from the auxiliary point G (S86).

Then, the position data of the end point a1 is stored into the position data buffer (S87). The position counter value N is initially set to one (S88). The position data of the division point j(N) and the position data of the division point k(N) are stored into the position data buffer (S89, S90). If the division point w(N) is present (S91: Yes), the position data of the division point w(N) is stored into the position data buffer (S93), and the position counter value N is incremented by 1 (S94). Then, the position data of the division point k(N), the position data of the division point j(N) and the position data of the division point u(N) are sequentially stored into the position data buffer (S95, S96, S97). The position counter value N is again incremented by 1 (S98). Then, steps S90 to S98 are repeated. If the division point w(N) does not exist (S91: No), the position data of the end point a4 is stored into the position data buffer (S92). Then, control returns to step S21.

The stitch data creation control routine executed when the fourth embroidery pattern SP4 is selected (see FIGS. 19A–19B) is described with reference to FIG. 6.

Figure 19A:
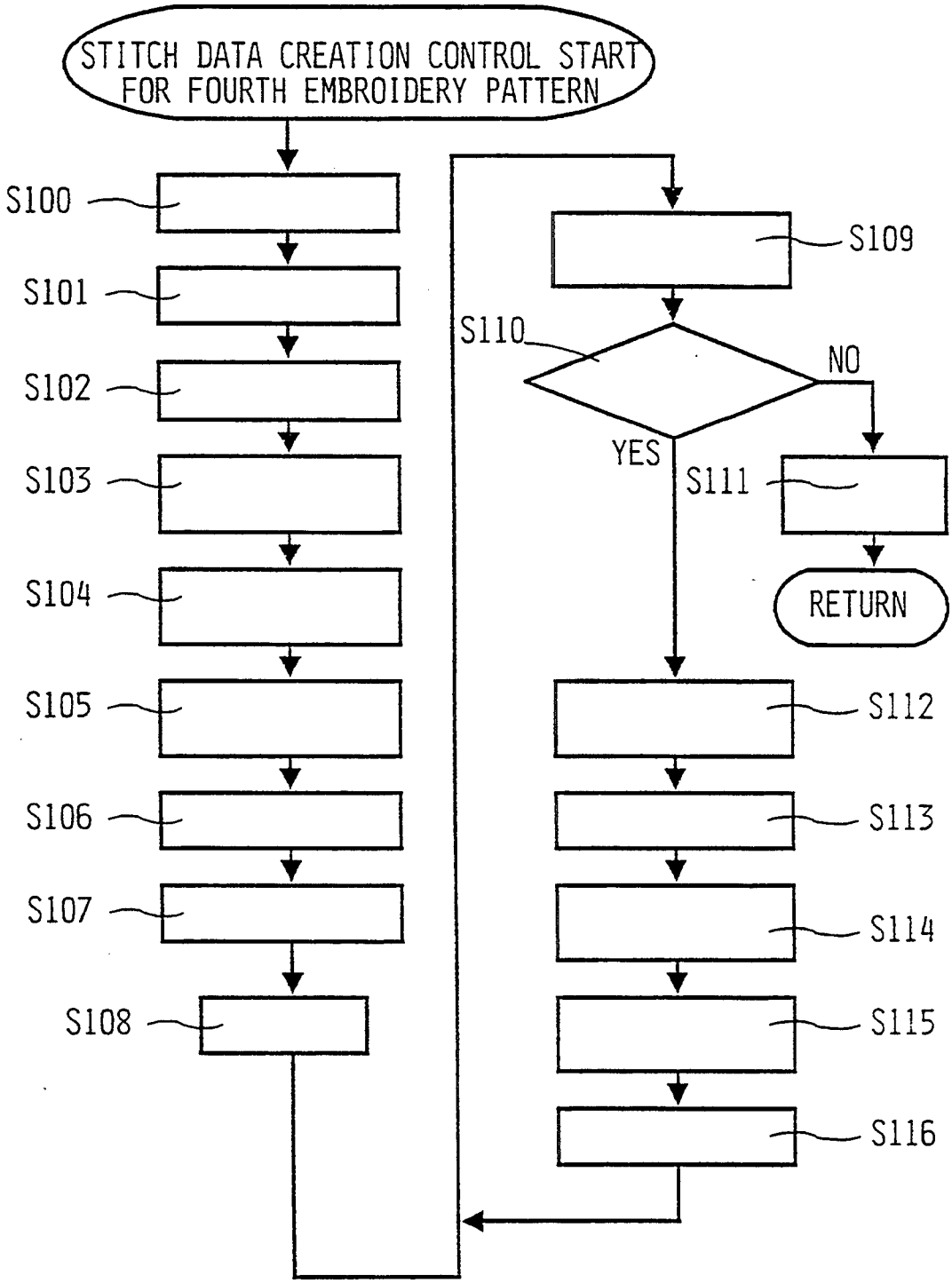

Referring to FIGS. 6 and 19A–19B, the girth length of the first main line L1 containing the end points a1 and a3 and the arbitrary auxiliary point a5 is determined to obtain the midpoint g of the first main line L1. The girth length of the second main line L2 containing the end points a2 and a4 and the arbitrary auxiliary point a6 is determined to obtain the midpoint h of the second main line L2 (S100). The perpendicular bisector $\alpha$ of the line segment PQ is obtained. The point r on the perpendicular bisector $\alpha$ is selected so that the distance between the points g and r is substantially equal to the distance between the points r and h (S101). Then, the girth length of the auxiliary main line L5 containing the auxiliary points P and Q and the point r is determined (S102).

The girth length of the auxiliary main line L5 is divided by a stitch pitch t to obtain a division number M (S103). However, if the division number M is an even number, "1" is added to the division number M to make M odd. The first main line L1 is divided by the division number M, to obtain division points u1–u(M−1), which are stored into the position data buffer sequentially from the end point a1 (S104). Similarly, the second main line L2 is divided by the division number M to obtain division points w1–w(M−1), which are stored into the position data buffer sequentially from the end point a2 (S105). The auxiliary main line L5 is divided by twice the division number, 2M, to obtain division points v1–v(2M−1). Odd ones v1, v3, . . . v(2M−1) of these division points are stored into the position data buffer sequentially from the auxiliary point P (S106).

The position data of the end point a1 is stored into the position data buffer (S107). The position counter value N is initially set to one (S108). The position data of the division point v(N) is stored into the position data buffer (S109). Then, if the division point w(N) is present (S110: Yes), the position data of the division point w(N) is stored into the position data buffer (S112). The position counter value N is incremented by 1 (S113). The position data of the division point v(N) and the position data of the division point u(N) are stored into the position data buffer (S114, S115). The position counter value N is again incremented by 1 (S116). Then, steps S109 to S116 are repeated. If the division point w(N) does not exist (S110: No), the position data of the end point a4 is stored into the position data buffer (S111). Then, control returns to step S21.

Figure 20A:
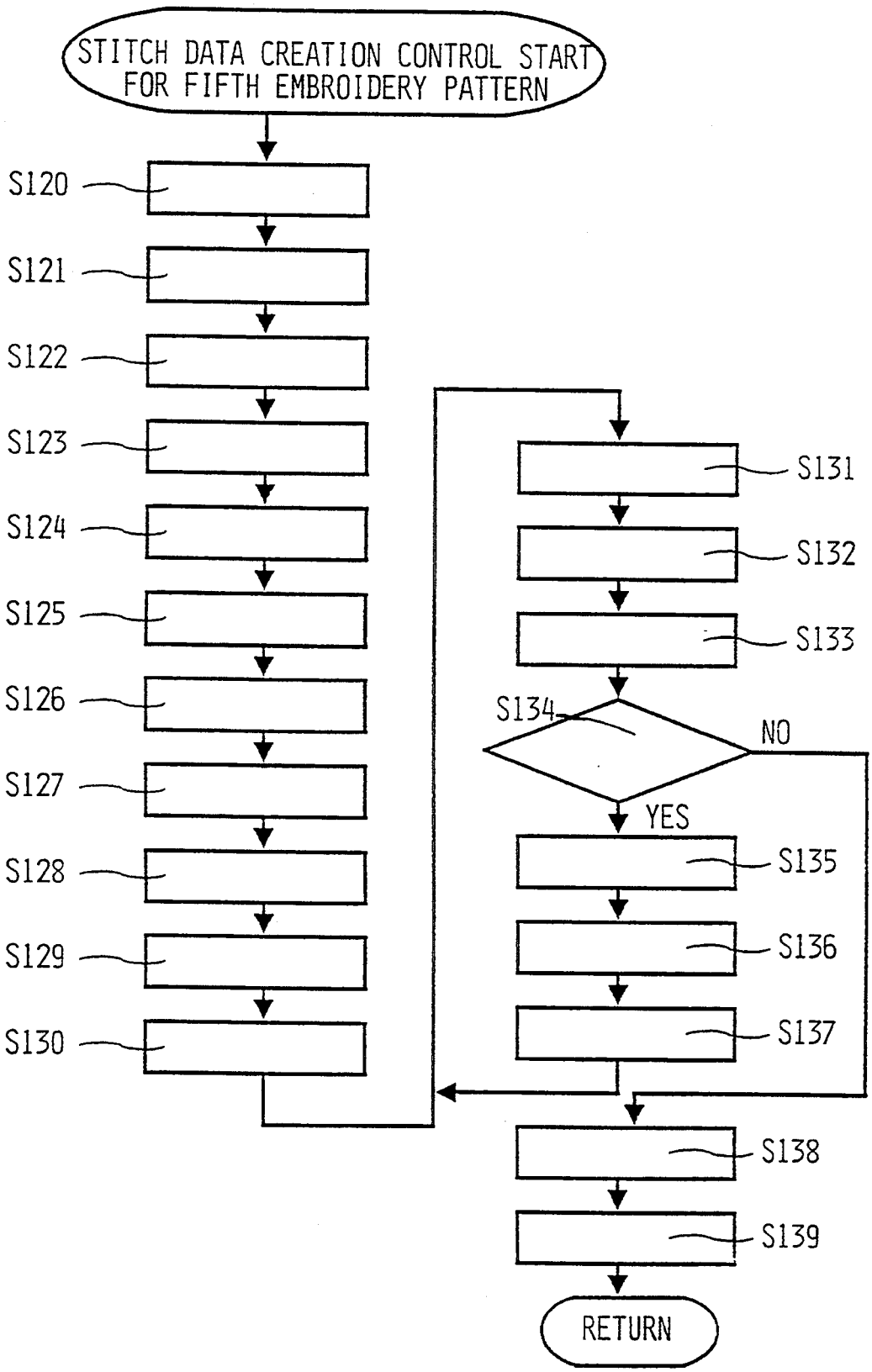

Finally, the stitch data creation control routine, executed when the fifth embroidery pattern SP5 is selected (see FIG. 7), is described with reference to FIGS. 20A–20C.

Referring to FIGS. 7 and 20A–20C, the girth length of the first main line L1 containing the end points a1 and a3 and the arbitrary auxiliary point a5 is determined to obtain the midpoint g of the first main line L1. The girth length of the second main line L2 containing the end points a2 and a4 and the arbitrary auxiliary point a6 is determined to obtain the midpoint h of the second main line L2 (S120). Similarly, the girth length of the first subline L3 containing the end points a1 and a2 and the arbitrary auxiliary point a7 is determined to obtain the midpoint P of the first subline L3. The girth length of the second subline L4 containing the end points a3 and a4 and the arbitrary auxiliary point a8 is determined to obtain the midpoint Q of the second subline L2 (S121). The perpendicular bisector $\alpha$ of the line segment PQ is obtained. The point r on the perpendicular bisector $\alpha$ is selected so that the distance between the points g and r is substantially equal to the distance between the points r and h (S122). The girth length of the auxiliary main line L5 containing the midpoints P and Q and the point r is determined (S123).

The girth length of the auxiliary main line L5 is divided by a stitch pitch t to obtain a division number M (S124). However, if the division number M is an even number, "1" is added to the division number M to make M odd. The first main line L1 is divided by the division number M to obtain division points u1–u(M−1), which are stored into the position data buffer sequentially from the end point a1 (S125). Similarly, the second main line L2 is divided by the division number M to obtain division points w1–w(M−1), which are stored into the position data buffer (S126). The auxiliary main line L5 is divided by twice the division number, 2M, to obtain division points v1–v(2M−1). Odd ones v1, v3 . . . , v(2M−1) of these division points are stored into the position data buffer sequentially from the midpoint P (S127). The position counter value N is initially set to one (S128). A circular arc e(N) containing the end point a1 and the division points v(N) and w(N) is determined (S129). The position data of the end point a1, the division points v(N) and w(N) and the plural auxiliary needle locations on the circular arc e(N) are stored into the position data buffer (S130). A circular arc e(N+1) containing the division points w(N), v(N+1) and u(N+1) is determined (S131). The position data of the division points v(N+1) and u(N+1) and the plural auxiliary needle locations on the circular arc e(N+1) are stored into the position data buffer (S132).

The position counter value N is incremented by 1 (S133). If the division point w(N+1) is present (S134: Yes), a circular arc e(N+1) containing the division points uN, v(N+1) and w(N+1) is determined (S135). The position data of the division points v(N+1) and w(N+1) and the plural auxiliary needle locations on the circular arc e(N+1) are stored into the position data buffer (S136). The position counter value N is again incremented by 1 (S137). The steps S131 to S137 are repeated. If the division point w(N+1) does not exist (S134: No), a circular arc e(N+1) containing the division points u(N) and v(N+1) and the end point a4 is determined (S138). The position data of the division point v(N+1), the end point a4 and the plural auxiliary needle locations on the circular arc e(N+1) are stored into the position data buffer (S139). Then, control returns to step S21.

Referring back to FIG. 14, the area count value C is incremented by 1 (S21). Then, if the current value C is not greater than the total number N of the embroidery areas (S22: No), steps S20 to S22 are repeated. If the stitch data for all the embroidery areas is created (S22: Yes), it is stored into a predetermined memory in the RAM 65 or a floppy disk loaded in the floppy disk drive unit 74. Then, control returns to a main routine.

Accordingly, in preparing the stitch data for the embroidery areas A1–A10 of the flower embroidery pattern 80 shown in FIG. 22, the embroidery pattern number SP10 is used for the embroidery areas A1 and A2. The embroidery pattern number SP1 is used for the embroidery areas A3 and A4. The embroidery pattern number SP7 is used for the embroidery areas A5–A10.

Figure 25:
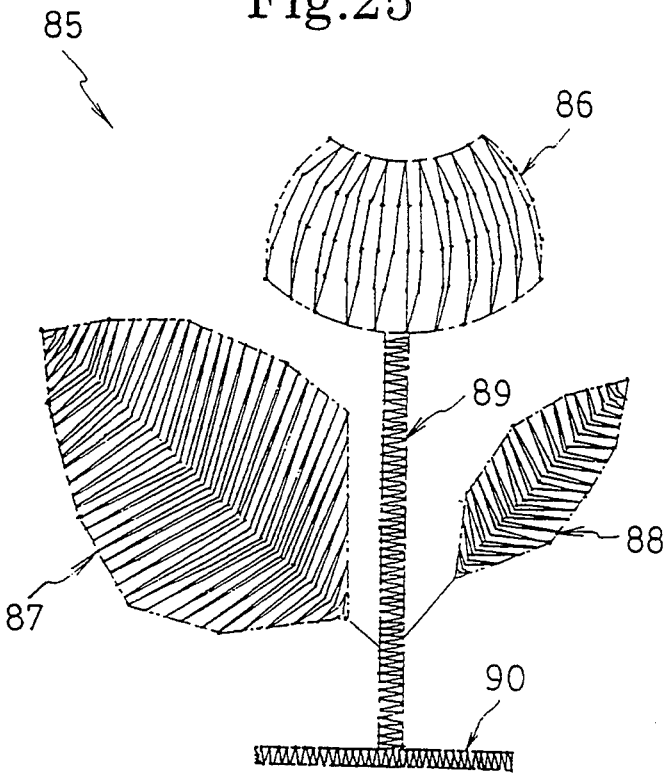
FIG. 25 is an illustration of embroidery stitches formed in the embroidery areas of another flower embroidery pattern.

Similarly, in preparing the stitch data for a flower embroidery pattern 85 shown in FIG. 25, the embroidery pattern SP5 is used for a corolla portion 86. The embroidery pattern SP2 is used for leaf portions 87 and 88. The embroidery pattern SP1 is used for a stem portion 89 and a ground portion 90.

Figure 26:
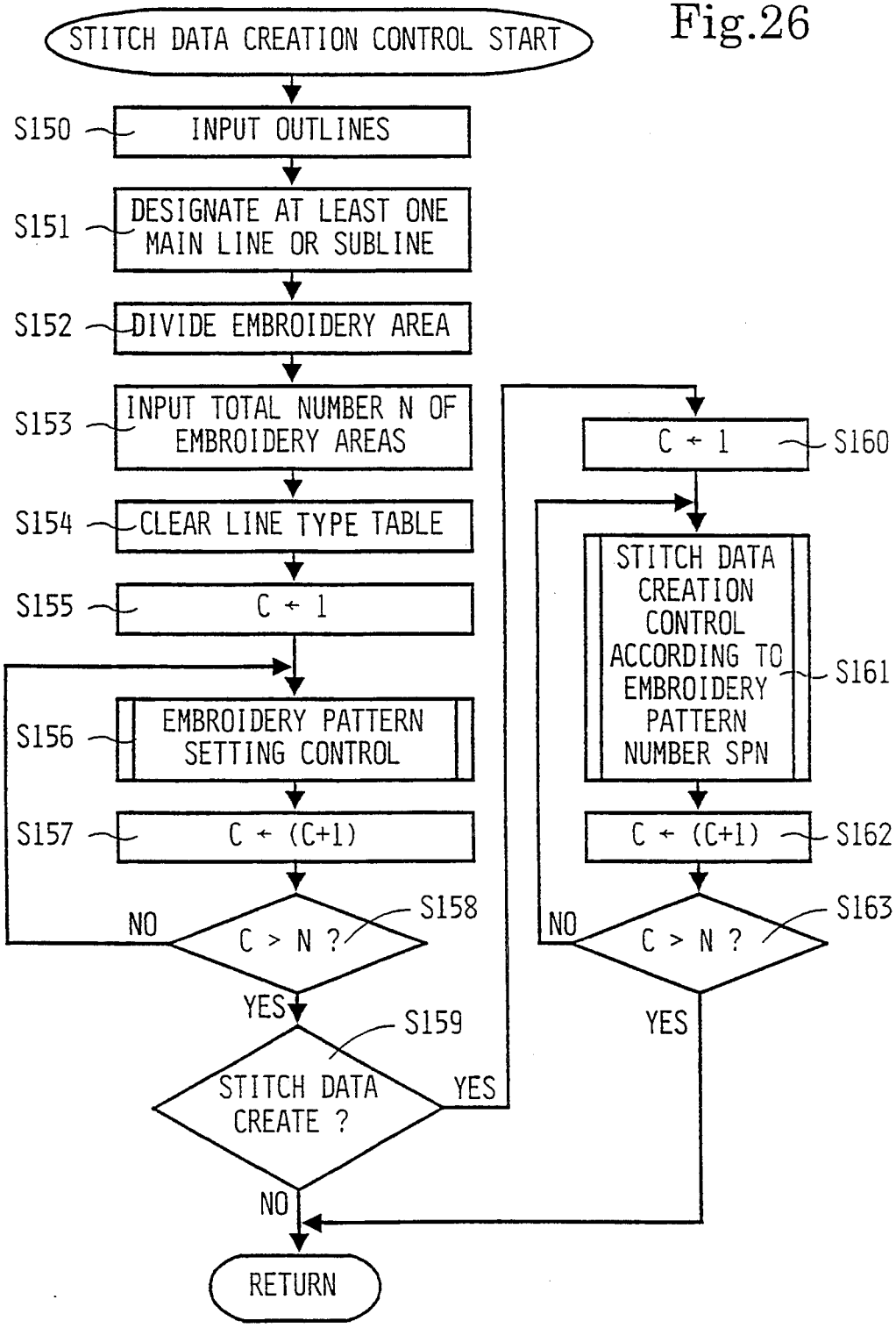
FIG. 26 is a schematic flowchart of a stitch data creation control routine according to a modified embodiment.

The stitch data creation control routine described above can be partially modified, as shown in FIG. 26, so that an embroidery area defined by a single outline is automatically divided into two or more subsections. In the flowchart of FIG. 26, steps S153–S163 are similar to steps S12–S22 of the stitch data creation control routine shown in FIG. 14. Accordingly, the detailed description of these steps is omitted.

Referring to FIG. 26, when the keyboard 57 is operated to command the creation of stitch data, this control routine is started to display a prompt for entry of the outline data defining an embroidery pattern. The mouse 59 is operated to designate an initial point and a terminal point as both end points of each line segment of the outline. The keyboard 57 is operated to designate the type of each line segment, thus inputting the outline data of the embroidery area. Accordingly, the outlines are sequentially displayed on the CRT display 56 (S150).

Figure 27:
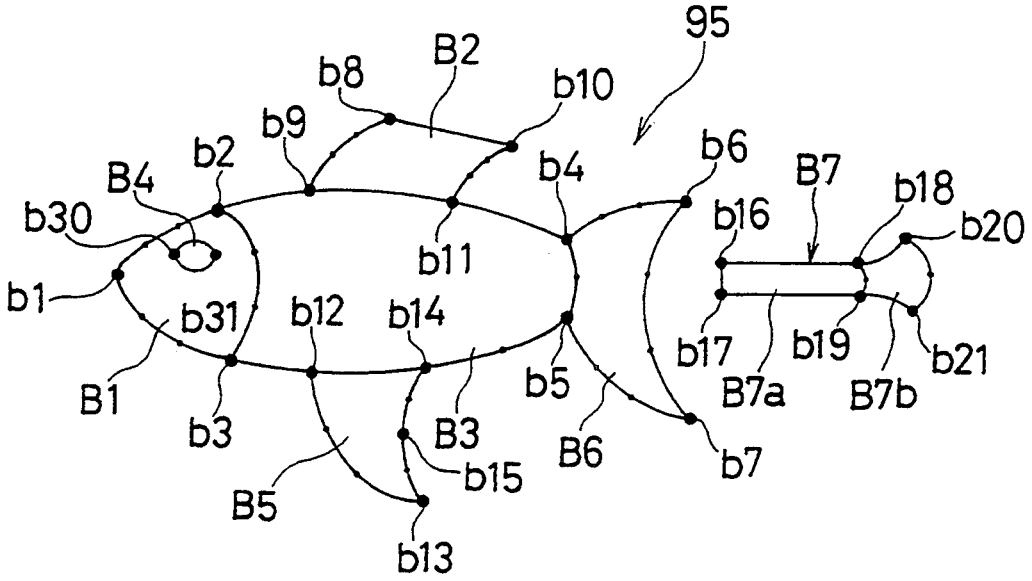
FIG. 27 is an illustration of embroidery areas constituting a fish embroidery pattern.
Figure 29:
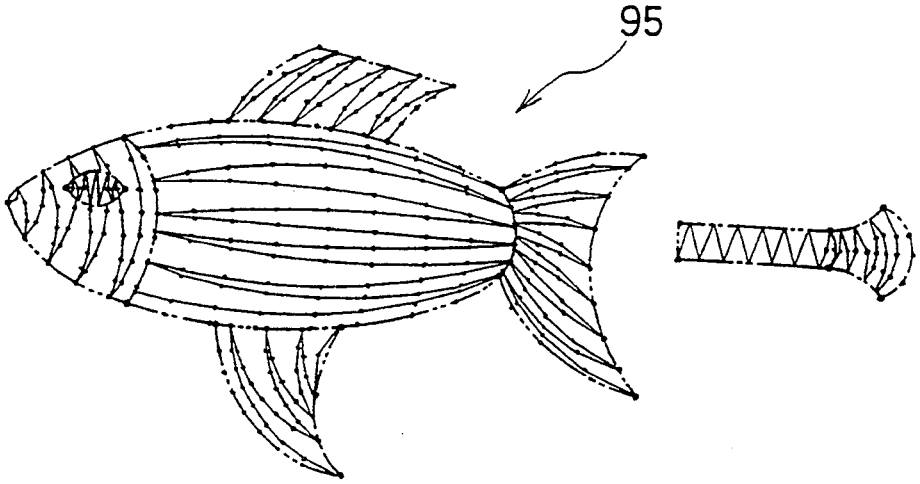
FIG. 29 is an illustration of embroidery stitches formed in the embroidery areas of the fish embroidery pattern.
Figure 30:
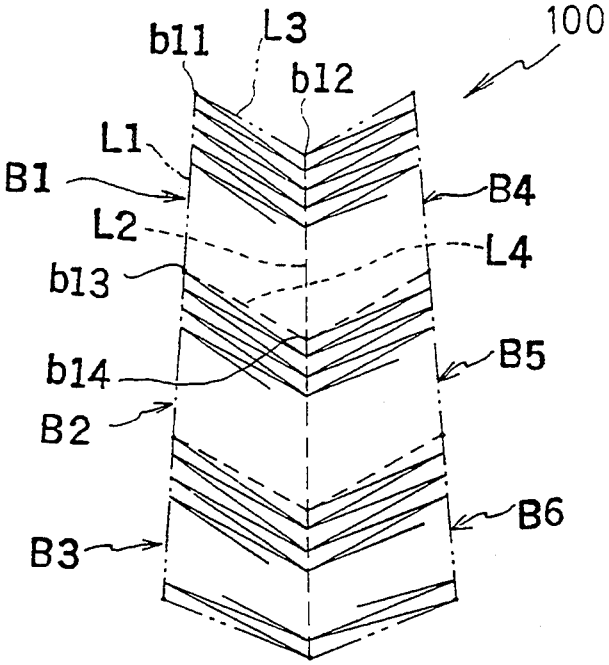
Fig.30 RELATED ART
FIG. 30 is an illustration of an embroidery zone divided into the small blocks of the prior art.

The type of each line segment, i.e., straight line, circular arc, broken line and spline curve, is designated. In designating any type of line other than the straight line, a plurality of outline defining points from the initial point to the terminal point are designated. When an embroidery pattern comprises a plurality of embroidery areas, outline data for every embroidery area is input. For example, as shown in FIG. 27, a fish embroidery pattern 95 comprises seven embroidery areas B1 to B7. In this example, outline data for each embroidery area B1 to B7 is input. Simultaneously, the type of each line segment of the outline is input. For example, end points b1, b2 and b3 and the other defining points are input for the embroidery area B1. End points b8, b9, b10 and b11 and the other defining points are input for the embroidery area B2. Similarly, the other end points up to an end point b21 and the other defining points are input for the embroidery areas B3 to B7.

The mouse 59 is operated to designate the line segments of each outline displayed on the CRT display 56. The keyboard 57 is operated to designate at least one main line or subline of each outline (S151). For example, in the case of the fish embroidery pattern 95 shown in FIG. 27, a line segment b1-b2 of the embroidery area B1 is designated as the first main line. A line segment b8-b10 of the embroidery area B2 is designated as the first main line. A line segment b2-b3 of the embroidery area B3 is designated as the first main line. A line segment b30-b31 of the embroidery area B4 is designated as the first main line. A line segment b12-b14 of the embroidery area B5 is designated as the first main line. A line segment b4-b5 of the embroidery area B6 is designated as the first main line. A line segment b16-b18 of the embroidery area B7 is designated as the first main line. Alternatively, a direction of stitches in each embroidery area may be input rather than the main line or the subline, a line element intersecting the direction at substantially right angles being designated as one of the main lines.

In step S152, the division routine for an embroidery area is executed. The following two types of routines are carried out. In the first case, the lines not designated in step S151 are determined as the main line or the subline according to the following three rules. The line segments opposed to each other are the same type (i.e., they are a pair of main lines or a pair of sublines). The line segment whose end points are common to two main lines is identified as a subline. The line segments adjacent to each other are of different types, and a main line may be continuous. According to these rules, the first main line, the second main line, the first subline and the second subline are automatically designated for each outline data.

In the second case, where the outline defining one embroidery area contains five or more line segments, the embroidery area is divided into two or more subsections according to the main line or subline designated. For example, the embroidery area B7 of the fish embroidery pattern 95 shown in FIG. 27 contains six line segment b16-b17, b17-b19, b19-b21, b21-b20, b20-b18 and b18-b16. The line segment b16-b18 is designated as the first main line. Accordingly, the embroidery area B7 is divided into two subsections B7*a* and B7*b*. Thereafter, the keyboard 57 is operated to designate a number N indicating the total number of embroidery areas of the embroidery pattern (S153). Then, steps S154–S163 are executed.

Accordingly, as shown in FIG. 28, a line type table LT2 showing the correspondence between the embroidery areas B1–B7*b* and the types of the first main line, the second main line, the first subline and the second subline is created and stored into the working memory. However, in the first subline of the embroidery area B1, the first main line of the embroidery area B2, the first subline and the second subline of the embroidery area B4, and the first subline of the embroidery area B7*a*, the line type of the other main line or the other subline is written. The embroidery pattern numbers are set to correspond to the embroidery areas B1–B7*b*. The stitch data is created according to the embroidery pattern numbers in the same manner as that in the previous preferred embodiment.

As described above, an optimum embroidery pattern for making embroidery stitches in an embroidery area input from the keyboard 57 is automatically determined according to the data of the outline defining points, the types of line segments of the outline defining the input embroidery areas, and at least one of the designated main lines and the designated sublines. The stitch data is automatically created by the stitch data creation control routine corresponding to this optimum embroidery pattern. Accordingly, the shape of the embroidery area can be freely set without limitation.

Further, since the embroidery zone, which had to be divided into a plurality of blocks in the prior art, can be defined as a single embroidery area, the number of divisions of the embroidery area can be greatly reduced. Further, since the stitch data is created by using the embroidery patterns SP1–SP10 associated with the types of the main lines and the types of the sublines, embroidery stitches reflecting the shape of the embroidery area can be formed. In addition, since the number of divided embroidery areas forming the embroidery pattern is reduced, the number of spaces between the embroidery areas adjacent to each other can be reduced to realize a high-quality embroidery stitch pattern.

In modification, the image of an embroidery pattern is read by the scanner 60, and the outline is created according to the image data. Each line segment of the outline is designated as a main line or a subline. Further, the spline curve used in the above preferred embodiments can be replaced by a Bezier curve designated by a pair of control points. Further, the pair of sublines may combine the combination of a straight line and a circular arc. The pair of main lines may comprise the combination of a free-form curve and a circular arc.

The embroidery patterns shown in the above preferred embodiments are merely illustrative. Any other line can be used for the first and second main lines L1 and L2 and the first and second sublines L3 and L4. Further, in the above preferred embodiments, the first embroidery pattern SP1 is formed as a V-shaped stitch pattern, the needle locations determined from the end point a1 through the division points v1, u2, v3, . . . to the end point a4. However, the first embroidery pattern SP1 can be formed as an inverted N-shaped stitch pattern, the needle locations determined from the end point a1 through the end point a2 and the division points u1, v1, u2, v2, . . . to the end point a4. The other embroidery patterns SP2–SP10 may be similarly modified determine the needle locations. Further, the control program for the stitch data creation control routine can be stored in the external storage unit 58. Further, the data processing unit 55 can be built in the embroidery unit 2.

It is to be understood that the present invention is not restricted to the particular forms shown in the foregoing embodiment. Various modifications and alterations can be added thereto without departing from the scope and spirit of the invention encompassed by the appended claims.

What is claimed is:

1. A stitch data preparing device and data utilization means for (a) determining an optimal embroidery pattern for an embroidery area of an embroidery figure, the embroidery area being defined by a pair of main lines and a pair of sublines connecting the pair of main lines, the optimal embroidery pattern comprising an embroidery stitch path extending between the pair of main lines and running from a first end of the pair of main lines to a second end of the pair of main lines, and (b) utilizing stitch data to form a series of stitches, the stitch data preparing device comprising:

first storing means for storing a plurality of predetermined embroidery patterns, each predetermined embroidery pattern defined by a line type of at least one of the pair of main lines and a line type of at least one of the pair of sublines and for storing a predetermined stitch path creation control routine corresponding to each predetermined embroidery pattern;

second storing means for storing defining points located on an outline of the embroidery area and for storing a plurality of line elements, each line element connecting at least two of the defining points, the plurality of line elements defining the outline;

line designating means for designating at least one main line and at least one subline of the embroidery area from the plurality of line elements stored in said second storing means for determining the line type of each designated main line and subline;

determining means for automatically selecting one of the plurality of embroidery patterns for the embroidery area based on the line types of the at least one designated main line and the at least one designated subline designated by said line designating means, and for automatically determining an embroidery stitch path for the embroidery area based on the selected pattern; and data utilization means for utilizing stitch data corresponding to said embroidering stitch path to form a series of stitches.

2. The stitch data preparing device of claim 1, wherein the line type of the at least one main line is one of a straight line, an arc, and a spline curve.

3. The stitch data preparing device of claim 1, wherein the line type of the at least one subline is one of a straight line, a polygonal line, an arc and a spline curve.

4. The stitch data preparing device of claim 3, wherein the polygonal line has two line segments.

5. The stitch data preparing device of claim 3, wherein the polygonal line has at least three line segments.

6. The stitch data preparing device of claim 1, wherein the plurality of embroidery patterns comprises at least two of:

a first embroidery pattern comprising straight-type main lines and straight-type sublines;

a second embroidery pattern comprising straight-type main lines and polygonal-type sublines each having two line segments;

a third embroidery pattern comprising straight-type main lines and polygonal-type sublines, at least one polygonal subline having at least three line segments;

a fourth embroidery pattern comprising arc-type main lines and polygonal-type sublines each having two line segments;

a fifth embroidery pattern comprising arc-type main lines and arc-type sublines;

a sixth embroidery pattern comprising arc-type main lines and polygonal-type sublines, at least one polygonal subline having at least three line segments;

a seventh embroidery pattern comprising spline curve-type main lines and polygonal-type sublines each having two line segments;

an eighth embroidery pattern comprising spline curve-type main lines and polygonal-type sublines, at least one polygonal subline having at least three line segments;

a ninth embroidery pattern comprising spline curve-type main lines and arc-type sublines; and a tenth embroidery pattern comprising spline curve-type main lines and spline curve-type sublines.

7. The stitch data preparing device of claim 1, wherein one of the pair of sublines is a zero length line segment such that the pair of main lines are connected to each other.

8. The stitch data preparing device of claim 1, further comprising:

stitch data generating means for generating a plurality of stitch needle locations based on the determined embroidery pattern and the determined embroidery stitch path;

an embroidery sewing machine for automatically sewing the embroidery figure onto a work fabric; and a controller for operating the embroidery sewing machine based on the plurality of stitch needle locations to form the embroidery figure.

9. A stitch data preparing device and data utilization means for an embroidery sewing machine, the stitch data comprising a plurality of connected needle locations defining an embroidery area defined by at least one main line and at least one subline, the stitch data preparing device comprising:

first storing means for storing a plurality of embroidery patterns, each pattern defined by a combination of at least one main line type and at least one subline type, and for storing a corresponding plurality of stitch data generation control routines, each control routine generating the needle locations of a corresponding one of the plurality of embroidery patterns;

second storing means for storing first data points defining the at least one main line and at least one subline and for storing line segment type data of the at least one main line and at least one subline;

first selecting means for selecting at least one of the at least one main line and at least one of the at least one subline;

second selecting means for selecting one of the plurality of embroidery patterns based on the at least one selected main line and at least one selected subline;

defining means for defining second data points for at least one of an auxiliary main line and auxiliary points on one of the at least one main line and at least one subline based on the selected embroidery pattern; and data utilization means for utilizing said stitch data to form a series of stitches.

10. The stitch data preparing device of claim 9, wherein the line type of the at least one main line is one of a straight line, an arc, and a spline curve.

11. The stitch data preparing device of claim 9, wherein the line type of the at least one subline is one of a straight line, a polygonal line, an arc and a spline curve.

12. The stitch data preparing device of claim 9, wherein the polygonal line has two line segments.

13. The stitch data preparing device of claim 9, wherein the polygonal line has at least three line segments.

14. The stitch data preparing device of claim 9, wherein the plurality of embroidery patterns comprise at least two of:

a first embroidery pattern comprising straight-type main lines and straight-type sublines;

a second embroidery pattern comprising straight-type main lines and polygonal-type sublines each having two line segments;

a third embroidery pattern comprising straight-type main lines and polygonal-type sublines, at least one polygonal subline having at least three line segments;

a fourth embroidery pattern comprising arc-type main lines and polygonal-type sublines each having two line segments;

a fifth embroidery pattern comprising arc-type main lines and arc-type sublines;

a sixth embroidery pattern comprising arc-type main lines and polygonal-type sublines, at least one polygonal subline having at least three line segments;

a seventh embroidery pattern comprising spline curve-type main lines and polygonal-type sublines each having two line segments;

an eighth embroidery pattern comprising spline curve-type main lines and polygonal-type sublines, at least one polygonal subline having at least three line segments;

a ninth embroidery pattern comprising spline curve-type main lines and arc-type sublines; and a tenth embroidery pattern comprising spline curve-type main lines and spline curve-type sublines.

15. The stitch data preparing device of claim 9, wherein one of the pair of sublines is a zero length line segment such that the pair of main lines are connected to each other.

16. The stitch data preparing device of claim 9, further comprising:

stitch data generating means for generating a plurality of stitch needle locations based on the determined embroidery pattern and the determined embroidery stitch path;

an embroidery sewing machine for automatically sewing the embroidery figure onto a work fabric; and a controller for operating the embroidery sewing machine based on the plurality of stitch needle locations to form the embroidery figure.

17. A method for determining and forming an optimal embroidery pattern for an embroidery area of an embroidery figure, comprising the steps of:

dividing the figure into at least one embroidery area;

designating, for each embroidery area, a pair of main lines and at least one subline, the pair of main lines and at least one subline forming a boundary of the embroidery area;

determining a line-type of each main line and each subline of the embroidery area;

determining the optimal embroidery pattern based on the determined line types of at least one of the pair of main lines and at least one of the at least one subline;

determining an embroidery stitch path based on the determined optimal embroidery pattern, the pair of main lines and the at least one subline, the embroidery stitch path extending between the pair of main lines and running from a first end of the pair of main lines to a second end of the pair of main lines; and utilizing said stitch data to form a series of stitches.

18. The embroidery pattern determining method of claim 17, wherein the determined line-type of each of the main lines is one of a straight line, an arc and a spline curve.

19. The embroidery pattern determining method of claim 17, wherein the determined line-type of each of the sublines is one of a straight line, a polygonal line, an arc and a spline curve.

20. The embroidery pattern determining method of claim 17, comprises the steps of:

determining if one of the pair of main lines is a spline curve;

designating a main line type as a spline curve when one of the pairs of main lines is a spline curve;

determining, when neither main line is a spline curve, if one of the pair of main lines is an arc;

designating the main line-type as a circular arc when neither main line is a spline curve and one of the pair of main lines is an arc;

designating the main line-type as a straight line when neither main line is a spline curve and neither main line is an arc; and selecting the optimal embroidery pattern based on the designated main-line type.

21. The embroidery pattern determining method of claim 20, wherein, when the designated main line-type is a spline curve, the embroidery pattern determining step further comprises the steps of:

determining if at least one subline is a spline curve;

designating a subline-type as a spline curve when at least one subline is a spline curve;

determining if at least one subline is an arc when no subline is a spline curve;

designating the subline-type as a circular arc when no subline is a spline curve and at least one subline is an arc;

determining if at least one subline is a polygonal line having at least three line segments if no subline is a spline curve and no subline is an arc curve;

designating the subline-type as a complex polygonal line when at least one subline is an at least three-line-segment polygonal line, no subline is a spline curve and no subline is an arc;

designating the subline type as a simple polygonal line when no subline is an at least three-line-segment polygonal line, no subline is a spline curve and no subline is an arc; and selecting the optimal embroidery pattern based on the designated subline type.

22. A stitch data preparing device for determining an optimal embroidery pattern for an embroidery area of an embroidery figure and a data utilization device, the embroidery area being defined by a pair of main lines and a pair of sublines connecting the pair of main lines, the optimal embroidery pattern comprising an embroidery stitch path extending between the pair of main lines and running from a first end of the pair of main lines to a second end of the pair of main lines, the stitch data preparing device comprising:

a first memory device for storing a plurality of predetermined embroidery patterns, each predetermined embroidery pattern defined by a line type of at least one of the pair of main lines and a line type of at least one of the pair of sublines and for storing a predetermined stitch path creation control routine corresponding to each predetermined embroidery pattern;

a second memory device, coupled to said first memory device, for storing defining points located on an outline of the embroidery area and for storing a plurality of line elements, each line element connecting at least two of the defining points, the plurality of line elements defining the outline;

an input interface, coupled to said first memory device and said second memory device, for designating at least one main line and at least one subline of the embroidery area from the plurality of line elements stored in said second memory device for determining the line type of each designated main line and subline;

a data processor, coupled to said input interface, for automatically selecting one of the plurality of embroidery patterns for the embroidery area based on the line types of the at least one designated main line and the at least one designated subline designated by said input interface, and for automatically determining an embroidery stitch path for the embroidery area based on the selected pattern; and a sewing device, coupled to said data processor, for utilizing stitch data corresponding to said embroidery stitch path to form a series of stitches.

* * * * *